US009269264B2

(12) United States Patent
Shimizu et al.

(10) Patent No.: US 9,269,264 B2
(45) Date of Patent: Feb. 23, 2016

(54) VEHICLE DRIVING ASSISTANCE DEVICE

(75) Inventors: Tsuyoshi Shimizu, Susono (JP); Tadahiro Kashiwai, Susono (JP); Masayoshi Hoshino, Toyota (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 474 days.

(21) Appl. No.: 13/639,750

(22) PCT Filed: Mar. 2, 2011

(86) PCT No.: PCT/JP2011/054741

§ 371 (c)(1),
(2), (4) Date: Oct. 5, 2012

(87) PCT Pub. No.: WO2011/125393

PCT Pub. Date: Oct. 13, 2011

(65) Prior Publication Data

US 2013/0030688 A1 Jan. 31, 2013

(30) Foreign Application Priority Data

Apr. 7, 2010 (JP) ..... PCT/JP2010/056298

(51) Int. Cl.
*G08G 1/0967* (2006.01)
*G08G 1/01* (2006.01)
(Continued)

(52) U.S. Cl.
CPC ..... *G08G 1/096791* (2013.01); *G08G 1/0112* (2013.01); *G08G 1/096708* (2013.01); *G08G 1/096725* (2013.01); *G08G 1/161* (2013.01); *G08G 1/0965* (2013.01); *G08G 1/22* (2013.01)

(58) Field of Classification Search
CPC ..... G08G 1/096791; G08G 1/096725; G08G 1/0965; G08G 1/22; G08G 1/0112; G08G 1/052; G08G 1/08; G08G 1/096708; G08G 1/161
USPC ..... 701/23, 26, 414, 423, 301, 302
See application file for complete search history.

(56) References Cited

U.S. PATENT DOCUMENTS 6,292,725 B1 * 9/2001 Kageyama et al. ..... 701/23
6,397,141 B1 * 5/2002 Binnig ..... 340/903
(Continued)

FOREIGN PATENT DOCUMENTS

JP 2003-051100 A 2/2003
JP 2006-059188 A 3/2006
(Continued)

OTHER PUBLICATIONS

International Search Report mailed Mar. 29, 2011 of PCT/JP2011/054741.

*Primary Examiner* — Tuan C. To
*Assistant Examiner* — Dale W Hilgendorf
(74) *Attorney, Agent, or Firm* — Kenyon & Kenyon LLP

(57) ABSTRACT

A vehicle driving assistance device according to the invention is intended to improve the reliability of driving assistance and includes a vehicle sensor that acquires vehicle behavior information about the behavior of a vehicle, an inter-vehicle communication unit that acquires other-vehicle behavior information about the behavior of another vehicle which travels in front of the vehicle, a traffic condition estimating unit that estimates traffic conditions between the vehicle and another vehicle on the basis of the vehicle behavior information and the other-vehicle behavior information, and a driving assistance unit that performs driving assistance on the basis of the estimation result of the traffic condition estimating unit.

6 Claims, 15 Drawing Sheets

(51) Int. Cl.

| | |
|---|---|
| ***G08G 1/16*** | (2006.01) |
| ***G08G 1/0965*** | (2006.01) |
| ***G08G 1/00*** | (2006.01) |

(56) References Cited

U.S. PATENT DOCUMENTS

| | | | | |
|---|---|---|---|---|
| 6,708,085 | B2 * | 3/2004 | Yamane et al. | 340/905 |
| 6,963,795 | B2 * | 11/2005 | Haissig et al. | 701/301 |
| 7,206,686 | B2 * | 4/2007 | Sawamoto et al. | 340/903 |
| 7,439,853 | B2 * | 10/2008 | Tengler et al. | 340/901 |
| 7,474,231 | B2 * | 1/2009 | Sohr | 701/301 |
| 2001/0034575 | A1 * | 10/2001 | Takenaga | G08G 1/096791 701/96 |
| 2006/0155469 | A1 * | 7/2006 | Kawasaki | 340/903 |
| 2008/0071465 | A1 * | 3/2008 | Chapman | G08G 1/0116 701/117 |
| 2008/0275618 | A1 * | 11/2008 | Grimm et al. | 701/96 |
| 2009/0309757 | A1 * | 12/2009 | Mudalige et al. | 340/905 |
| 2010/0045488 | A1 * | 2/2010 | Bell | G08G 1/161 340/988 |
| 2011/0001634 | A1 * | 1/2011 | Yokoyama | G08G 1/096791 340/905 |
| 2013/0041573 | A1 * | 2/2013 | Ochi | G08G 1/0116 701/117 |
| 2013/0328698 | A1 * | 12/2013 | Ramachandran | G08G 1/0112 340/905 |
| 2014/0210645 | A1 * | 7/2014 | Sharma | G08G 1/052 340/907 |
| 2014/0358413 | A1 * | 12/2014 | Trombley | G08G 1/0112 701/118 |

FOREIGN PATENT DOCUMENTS

| | | | |
|---|---|---|---|
| JP | 2006-185136 | A | 7/2006 |
| JP | 2008-090587 | A | 4/2008 |
| JP | 2009-116692 | A | 5/2009 |
| JP | 2009-151562 | A | 7/2009 |
| JP | 2009-205635 | A | 9/2009 |
| JP | 2010-036862 | A | 2/2010 |

* cited by examiner (a)

(b)

VEHICLE DRIVING ASSISTANCE DEVICE

This is a 371 national phase application of PCT/JP2011/054741 filed 2 Mar. 2011, claiming priority to PCT/JP2010/056298 filed 7 Apr. 2010, the contents of which are incorporated herein by reference.

TECHNICAL FIELD

The present invention relates to a vehicle driving assistance device that performs driving assistance.

BACKGROUND ART

A device has been proposed which estimates traffic conditions around a host vehicle on the basis of information acquired by, for example, inter-vehicle communication with other vehicles and performs driving assistance corresponding to the estimation result. For example, Japanese Unexamined Patent Application Publication No. 2006-185136 discloses a driving assistance device that estimates the number of other vehicles which cannot perform communication between the host vehicle and another vehicle which travels in front of the host vehicle and can perform inter-vehicle communication on the basis of the distance between another vehicle and the host vehicle. In the driving assistance device, when the number of other vehicles which cannot perform inter-vehicle communication is estimated from the inter-vehicle distance, the interval at which there is a communication-incapable vehicle is calculated using various maps corresponding to an inter-vehicle time, a traveling time, and a traveling region on the basis of the speed of another vehicle acquired by inter-vehicle communication. In this manner, estimation accuracy is improved.

CITATION LIST

Patent Literature

[Patent Literature 1] Japanese Unexamined Patent Application Publication No. 2006-185136

SUMMARY OF INVENTION

Technical Problem

However, in the above-mentioned driving assistance device according to the related art, it is difficult to say that the accuracy of estimation for the number of other vehicles incapable of performing inter-vehicle communication is high, and reliability is not sufficient.

An object of the invention is to provide a vehicle driving assistance device which estimates traffic conditions between a vehicle and another vehicle on the basis of information about the behavior of the vehicle and information about the behavior of another vehicle and performs driving assistance on the basis of the estimation result, thereby improving the reliability of driving assistance.

Solution to Problem

In order to solve the problem, there is provided a vehicle driving assistance device including: a vehicle behavior information acquiring unit that acquires vehicle behavior information about behavior of a vehicle; an other-vehicle behavior information acquiring unit that acquires other-vehicle behavior information about behavior of another vehicle which travels in front of the vehicle; a traffic condition estimating unit that estimates traffic conditions between the vehicle and another vehicle, on the basis of the vehicle behavior information acquired by the vehicle behavior information acquiring unit and the other-vehicle behavior information acquired by the other-vehicle behavior information acquiring unit; and a driving assistance unit that performs driving assistance on the basis of an estimation result of the traffic condition estimating unit.

According to the vehicle driving assistance device of the invention, when the traffic conditions between the vehicle and another vehicle which travels in front of the vehicle and from which the other-vehicle behavior information can be acquired are bad, the behavior of another vehicle is likely to affect the behavior of the vehicle. When the traffic conditions are good, the behavior of another vehicle is less likely to affect the behavior of the vehicle. Therefore, it is possible to estimate the traffic conditions between the vehicle and another vehicle on the basis of the vehicle behavior information and the other-vehicle behavior information. According to the vehicle driving assistance device, the number of other vehicles from which the other-vehicle behavior information can be acquired between the vehicle and another vehicle or traffic density therebetween can be estimated as the traffic conditions. Therefore, it is possible to increase the amount of information which can be used for vehicle driving assistance and thus improve the reliability of the driving assistance.

In the vehicle driving assistance device according to the invention, the other-vehicle behavior information acquiring unit may acquire the other-vehicle behavior information using communication between the vehicle and another vehicle.

According to the vehicle driving assistance device, it is possible to acquire the other-vehicle behavior information of another vehicle which can perform inter-vehicle communication using inter-vehicle communication with high accuracy.

In the vehicle driving assistance device according to the invention, the vehicle behavior information may include information about a speed variation of the vehicle, the other-vehicle behavior information may include information about a speed variation of another vehicle, and the traffic condition estimating unit may estimate the traffic conditions between the vehicle and another vehicle on the basis of the information about the speed variation of another vehicle and the information about the speed variation of the vehicle.

According to the vehicle driving assistance device, the speed variation which is largely affected by another vehicle is considered as a behavior variation and the traffic conditions between the vehicle and another vehicle are estimated on the basis of the speed variation of another vehicle and the speed variation of the vehicle. Therefore, it is possible to improve estimation accuracy.

In the vehicle driving assistance device according to the invention, the traffic condition estimating unit may calculate a deceleration gain of the speed variation of the vehicle to the speed variation of another vehicle during deceleration on the basis of the information about the speed variation of another vehicle and the information about the speed variation of the vehicle and estimate the traffic conditions between the vehicle and another vehicle on the basis of the deceleration gain.

According to the vehicle driving assistance device, the traffic conditions between the vehicle and another vehicle are estimated using the deceleration gain at which the influence of the speed variation of the vehicle on the speed variation of another vehicle is noticeable, that is, the gain of the deceleration of the vehicle to the deceleration of another vehicle. Therefore, it is possible to further improve estimation accuracy.

In the vehicle driving assistance device according to the invention, the traffic condition estimating unit may calculate a delay time between a deceleration start time of another vehicle and a deceleration start time of the vehicle on the basis of the information about the speed variation of another vehicle and the information about the speed variation of the vehicle and estimate the traffic conditions between the vehicle and another vehicle on the basis of the delay time.

According to the vehicle driving assistance device, the traffic conditions between the vehicle and another vehicle are estimated using the delay time of the deceleration start time at which the influence of another vehicle is noticeable in the speed variation. Therefore, it is possible to further improve estimation accuracy.

The vehicle driving assistance device according to the invention may further include a vehicle position information acquiring unit that acquires position information of the vehicle. The other-vehicle behavior information acquired by the other-vehicle behavior information acquiring unit may include position information of another vehicle, and the traffic condition estimating unit may calculate a distance between the vehicle and another vehicle on the basis of the position information of the vehicle and the position information of another vehicle and estimate the traffic conditions between the vehicle and another vehicle on the basis of a variation in the inter-vehicle distance.

According to the vehicle driving assistance device, the influence of the behavior of another vehicle on the distance between the vehicle and another vehicle varies depending on the traffic conditions between the vehicle and another vehicle. Therefore, when the traffic conditions between the vehicle and another vehicle are estimated on the basis of a variation in the inter-vehicle distance, it is possible to further improve estimation accuracy.

The vehicle driving assistance device according to the invention may further include an immediately preceding vehicle behavior prediction unit that predicts behavior of an immediately preceding vehicle which travels directly in front of the vehicle on the basis of the other-vehicle behavior information and the estimation result of the traffic condition estimating unit. The driving assistance unit may perform the driving assistance on the basis of a behavior prediction result of the immediately preceding vehicle behavior prediction unit.

According to the vehicle driving assistance device, since the influence of the behavior of another vehicle from which the other-vehicle behavior information is acquired on an immediately preceding vehicle can be estimated from the traffic conditions between the vehicle and another vehicle estimated by the traffic condition estimating unit, it is possible to predict the behavior of the immediately preceding vehicle on the basis of the other-vehicle behavior information. Therefore, according to the vehicle driving assistance device, the behavior of the immediately preceding vehicle can be predicted from the behavior of another preceding vehicle and look-ahead driving assistance can be performed on the basis of the behavior prediction result of the immediately preceding vehicle.

In the vehicle driving assistance device according to the invention, the driving assistance unit may perform the driving assistance on the basis of information about road conditions between the vehicle and the immediately preceding vehicle.

According to the vehicle driving assistance device, for example, when an intersection is interposed between the vehicle and the immediately preceding vehicle, the influence of the behavior of the immediately preceding vehicle on the vehicle is changed. Therefore, the information about the road conditions information between the vehicle and the immediately preceding vehicle is considered to estimate the traffic conditions, which makes it possible to improve the reliability of driving assistance.

In the vehicle driving assistance device according to the invention, the driving assistance unit may adjust the amount of control of the driving assistance based on the behavior prediction result of the immediately preceding vehicle behavior prediction unit on the basis of a current traveling relationship between the vehicle and the immediately preceding vehicle.

According to the vehicle driving assistance device, since the behavior of the immediately preceding vehicle is likely to be different from the behavior prediction result of the immediately preceding vehicle behavior prediction unit, the amount of control of the look-ahead driving assistance is adjusted on the basis of the traveling relationship (for example, an inter-vehicle distance, a relative speed, and relative acceleration) between the vehicle and the immediately preceding vehicle to prevent the distance between the vehicle and the immediately preceding vehicle from being too short or too long. This contributes to improving the reliability of driving assistance.

Advantageous Effects of Invention

According to the invention, it is possible to improve the reliability of driving assistance.

BRIEF DESCRIPTION OF DRAWINGS

FIG. 9(*b*) is a graph illustrating the prediction result of the speed variation of an immediately preceding vehicle based on the speed variation of another vehicle shown in FIG. 9(*a*).

FIG. 14(*b*) is a diagram illustrating a situation in which the deceleration of the immediately preceding vehicle is greater than a predicted value. FIG. 14(*c*) is a diagram illustrating a situation in which the deceleration of the immediately preceding vehicle is less than a predicted value.

DESCRIPTION OF EMBODIMENTS

Figure 1:
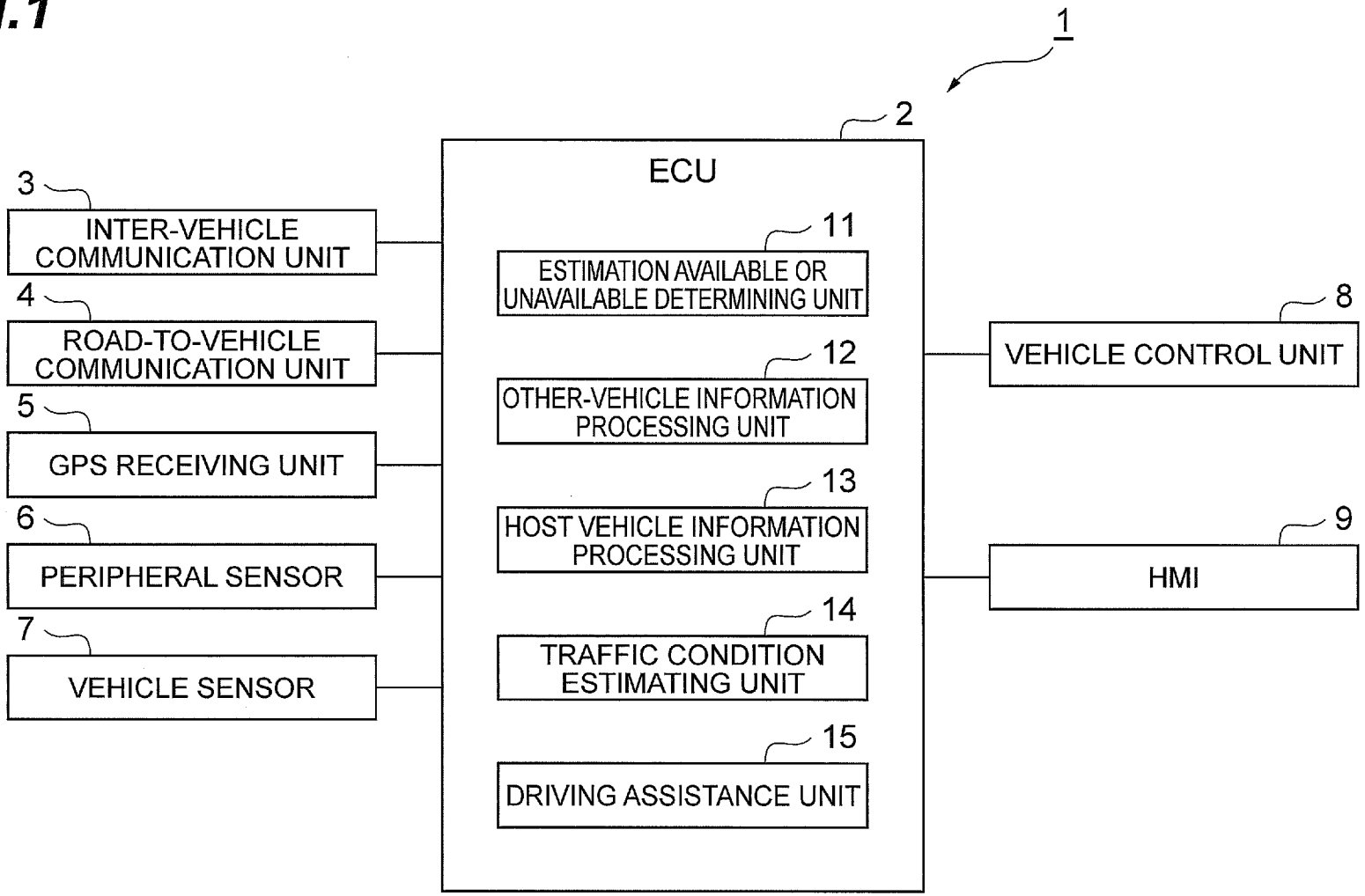
FIG. 1 is a block diagram illustrating a vehicle driving assistance device according to a first embodiment of the invention.

Hereinafter, exemplary embodiments of the invention will be described in detail with reference to the accompanying drawings. In the drawings, the same or equivalent components are denoted by the same reference numerals and the description thereof will not be repeated.

[First Embodiment]

Figure 2:
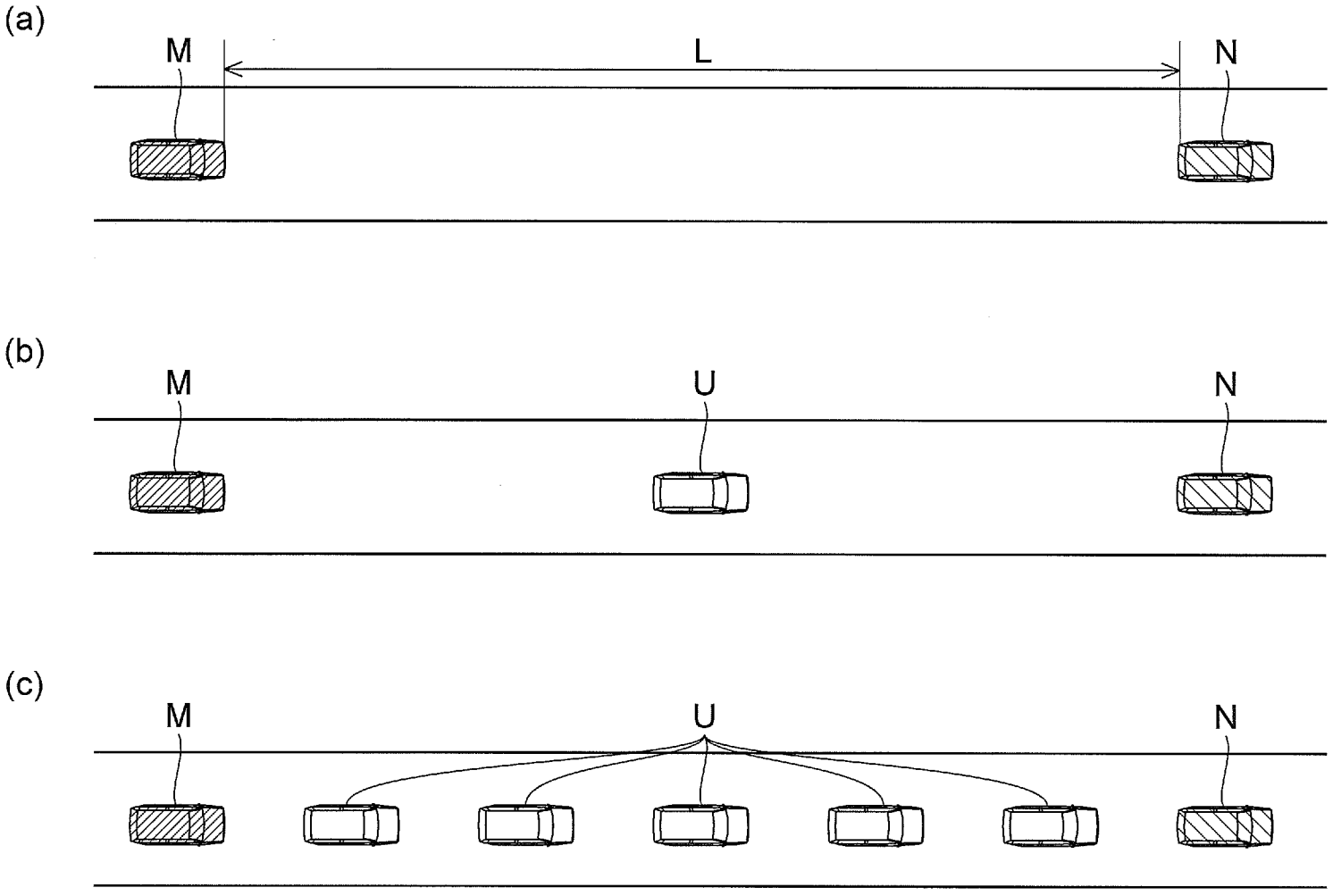
FIG. 2 is a diagram illustrating traffic conditions between a communication vehicle and a host vehicle.

As shown in FIGS. 1 and 2, a vehicle driving assistance device 1 according to a first embodiment is provided in a host vehicle M and assists the driver to drive the host vehicle M. The vehicle driving assistance device 1 performs communication with a communication vehicle N to estimate traffic conditions between the host vehicle M and the communication vehicle N and performs driving assistance on the basis of the estimation result of the traffic conditions. The communication vehicle N is another vehicle which travels in front of the host vehicle M on the same lane as that on which the host vehicle M travels and can perform inter-vehicle communication.

FIGS. 2(*a*) to 2(*c*) are diagrams illustrating the traffic conditions between the host vehicle M and the communication vehicle N. FIG. 2(*a*) shows a situation in which there is no vehicle which can perform communication between the host vehicle M and the communication vehicle N. FIG. 2(*b*) shows a situation in which there is only one communication-incapable vehicle U, which is a vehicle that cannot perform inter-vehicle communication, between the host vehicle M and the communication vehicle N. FIG. 2(*c*) shows a situation in which there are five communication-incapable vehicles U between the host vehicle M and the communication vehicle N.

Figure 3:
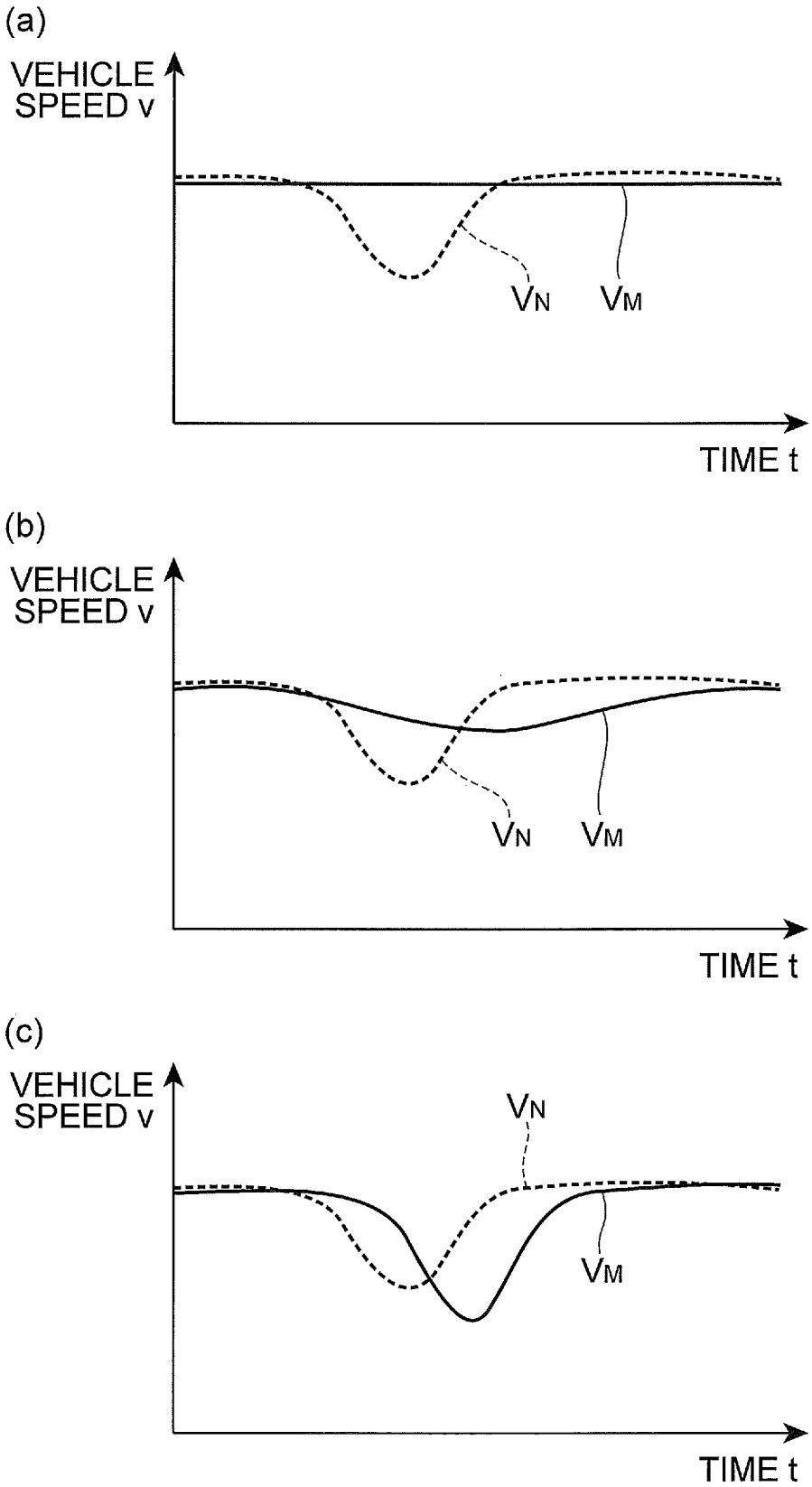
FIG. 3 is a graph illustrating the relationship between a speed variation of the communication vehicle and a speed variation of the host vehicle.

FIGS. 3(*a*) to 3(*c*) are graphs illustrating the relationship between the speed variation $V_N$ of the communication vehicle N and the speed variation $V_M$ of the host vehicle M. FIG. 3(*a*) is a graph corresponding to the situation shown in FIG. 2(*a*). FIG. 3(*b*) is a graph corresponding to the situation shown in FIG. 2(*b*). FIG. 3(*c*) is a graph corresponding to the situation shown in FIG. 2(*c*).

As shown in FIGS. 2 and 3, the vehicle driving assistance device 1 estimates the traffic conditions between the communication vehicle N and the host vehicle M from the associated relationship between the behavior of the communication vehicle N and the behavior of the host vehicle M on the basis of a variation in the influence of the behavior of the communication vehicle N on the behavior of the host vehicle M due to a variation in the traffic conditions between the communication vehicle N and the host vehicle M. The estimated traffic conditions include, for example, the number of communication-incapable vehicles U between the communication vehicle N and the host vehicle M, traffic density therebetween, and an average inter-vehicle time. The average inter-vehicle time is calculated by dividing the inter-vehicle time of the host vehicle M, which is obtained by dividing the distance L between the communication vehicle N and the host vehicle M by the vehicle speed V of the host vehicle M, by the number of communication-incapable vehicles U between the communication vehicle N and the host vehicle M.

Next, the structure of the vehicle driving assistance device 1 will be described.

As shown in FIG. 1, the vehicle driving assistance device 1 includes an ECU [Electronic Control Unit] 2 that controls the overall operation of the device. The ECU 2 is an electronic control unit including, for example, a CPU [Central Processing Unit], a ROM [Read Only Memory], and a RAM [Random Access Memory]. In the ECU 2, an application program stored in the ROM is loaded to the RAM and the CPU executes the application program to perform arithmetic processing related to traveling control, such as ACC [Adaptive Cruise Control] or brake assist. The ECU 2 is connected to an inter-vehicle communication unit 3, a road-to-vehicle communication unit 4, a GPS [Global Positioning System] receiving unit 5, a peripheral sensor 6, and a vehicle sensor 7. In addition, the ECU 2 is connected to a vehicle control unit 8 and an HMI [Human Machine Interface] 9.

The inter-vehicle communication unit 3 is a communication unit that communicates with other vehicles that can perform inter-vehicle communication. The inter-vehicle communication unit 3 performs inter-vehicle communication with other vehicles to acquire information about other vehicles. The information about other vehicles includes information about the behavior of other vehicles. The information about the behavior of other vehicles includes information about the position of other vehicles or information about the speed variation of other vehicle. The inter-vehicle communication unit 3 transmits the acquired information about other vehicles to the ECU 2. The inter-vehicle communication unit 3 functions as an other-vehicle behavior information acquiring unit described in the claims.

The road-to-vehicle communication unit 4 is a communication unit that wirelessly communicates with a road-side transceiver or an information center. The road-to-vehicle communication unit 4 performs wireless communication to acquire road information about the road on which the host vehicle M is traveling. The road information includes information about the number of lanes of the road or information about road alignments. The road-to-vehicle communication unit 4 transmits the acquired road information to the ECU 2.

The GPS receiving unit 5 receives GPS signals transmitted from a plurality of GPS satellites and detects the current position of the host vehicle M. The GPS receiving unit 5 transmits host vehicle position information about the detected current position of the host vehicle M to the ECU 2. The GPS receiving unit 5 functions as a vehicle position information acquiring unit described in the claims.

The peripheral sensor 6 monitors the surroundings of the host vehicle M. The peripheral sensor 6 includes various devices, such as a millimeter-wave radar and an external camera. The peripheral sensor 6 recognizes the white lane of the road using the external camera and acquires white line recognition information used to determine the lane. In addition, the peripheral sensor 6 recognizes other vehicles around the host vehicle M using, for example, the millimeter-wave radar or the external camera to acquire neighboring vehicle information. The peripheral sensor 6 transmits various kinds of information, such as the acquired white line recognition information or the acquired neighboring vehicle information, to the ECU 2.

The vehicle sensor 7 detects the behavior of the host vehicle M. The vehicle sensor 7 includes a vehicle speed sensor, a brake sensor, an acceleration sensor, a steering sensor, and an accelerator sensor. The vehicle sensor 7 acquires host vehicle behavior information about the behavior of the host vehicle M using various sensors. The host vehicle behavior information includes host vehicle speed variation information about the speed variation of the host vehicle M. The vehicle sensor 7 transmits the acquired host vehicle behavior information to the ECU 2. The vehicle sensor 7 functions as a vehicle behavior information acquiring unit described in the claims.

The vehicle control unit 8 is a control unit that controls the traveling of the host vehicle M. The vehicle control unit 8 includes various actuators, such as a throttle valve actuator, a brake actuator, and a steering actuator. The vehicle control unit 8 drives various actuators in response to driving assistance signals from the ECU 2 to control the traveling of the host vehicle M.

The HMI 9 is a facility that provides information to the driver of the host vehicle M. The HMI 9 includes a speaker that outputs audio information and a monitor that outputs video information. The HMI 9 provides the driver with various kinds of information used to drive the host vehicle M in response to the driving assistance signals from the ECU 2.

The ECU 2 includes an estimation available or unavailable determining unit 11, an other-vehicle information processing unit 12, a host vehicle information processing unit 13, a traffic condition estimating unit 14, and a driving assistance unit 15.

When the information about other vehicles is transmitted from the inter-vehicle communication unit 3, the estimation available or unavailable determining unit 11 determines whether it is possible to estimate the traffic conditions between the host vehicle M and another vehicle which has performed inter-vehicle communication. The estimation available or unavailable determining unit 11 determines whether it is possible to estimate the traffic conditions between the host vehicle M and another vehicle on the basis of the relationship between the host vehicle M and another vehicle which has performed inter-vehicle communication.

Specifically, the estimation available or unavailable determining unit 11 determines whether another vehicle which has performed inter-vehicle communication corresponds to the communication vehicle N, which is another vehicle that travels in front of the host vehicle M on the same lane as that on which the host vehicle M travels and can perform inter-vehicle communication, thereby determining whether it is possible to estimate the traffic conditions. In this case, first, the estimation available or unavailable determining unit 11 recognizes the lane on which the host vehicle M is traveling, on the basis of the road information from the road-to-vehicle communication unit 4, the host vehicle position information from the GPS receiving unit 5, and the white line recognition information from the vehicle sensor 7. Then, the estimation available or unavailable determining unit 11 determines whether another vehicle which has performed inter-vehicle communication corresponds to the communication vehicle N, on the basis of the information about the position of other vehicles included in the information about other vehicles from the inter-vehicle communication unit 3.

When it is determined that another vehicle which has performed inter-vehicle communication corresponds to the communication vehicle N, the estimation available or unavailable determining unit 11 determines that it is possible to estimate the traffic conditions between the communication vehicle N and the host vehicle M. In addition, when it is determined that another vehicle which has performed inter-vehicle communication does not correspond to the communication vehicle N, the estimation available or unavailable determining unit 11 determines that it is impossible to estimate the traffic conditions between the communication vehicle N and the host vehicle M. In addition, the estimation available or unavailable determining unit 11 may determine that it is impossible to estimate the traffic conditions when it is clear that the communication vehicle N is a vehicle which travels in front of the host vehicle M on the basis of the information about other neighboring vehicles from the peripheral sensor 6, that is, when it is clear that there is no vehicle between the host vehicle M and the communication vehicle N.

When the estimation available or unavailable determining unit 11 determines that it is possible to estimate the traffic conditions, the other-vehicle information processing unit 12 recognizes the speed variation $V_N$ of the communication vehicle N on the basis of the information about the speed variation of other vehicles included in the information about other vehicles from the inter-vehicle communication unit 3 (see FIG. 3).

When the other-vehicle information processing unit 12 recognizes the speed variation $V_N$ of the communication vehicle N, the host vehicle information processing unit 13 recognizes the speed variation $V_M$ of the host vehicle M corresponding to the speed variation $V_N$ of the communication vehicle N on the basis of the host vehicle speed variation information included in the host vehicle behavior information from the vehicle sensor 7 (see FIG. 3).

The traffic condition estimating unit 14 estimates the traffic conditions between the communication vehicle N and the host vehicle M on the basis of the speed variation $V_N$ of the communication vehicle N recognized by the other-vehicle information processing unit 12 and the speed variation $V_M$ of the host vehicle M recognized by the host vehicle information processing unit 13.

Specifically, when a transfer function G(s) having the speed variation $V_N$ of the communication vehicle N as an input u(s) and the speed variation $V_M$ of the host vehicle M as an output y(s) is assumed, the traffic condition estimating unit 14 calculates parameters A, B, and C of the transfer function G(s) using the following Expressions (1) and (2). In Expression (1), "s" is a Laplace operator. In Expression (2), "e" is an exponential.

[Equation 1]

$$G(s) = \frac{y(s)}{u(s)} \tag{1}$$

$$G(s) = \frac{A \times e^{-Bs}}{1 + Cs} \tag{2}$$

The traffic condition estimating unit 14 has a map in which the parameters A, B, and C of the transfer function G(s) are associated with the traffic conditions (for example, the number of communication-incapable vehicles U) between the communication vehicle N and the host vehicle M. The traffic condition estimating unit 14 estimates the traffic conditions between the communication vehicle N and the host vehicle M from the calculated parameters A, B, and C using the map.

In addition, the traffic condition estimating unit 14 may have a plurality of kinds of maps corresponding to a distance L between the communication vehicle N and the host vehicle M. In this case, the traffic condition estimating unit 14 accurately estimates the traffic conditions between the communication vehicle N and the host vehicle M from the parameters A, B, and C using the map which is selected on the basis of the distance L between the communication vehicle N and the host vehicle M. The traffic condition estimating unit 14 functions as a traffic condition estimating unit described in the claims.

When the traffic condition estimating unit 14 estimates the traffic conditions between the communication vehicle N and the host vehicle M, the driving assistance unit 15 performs driving assistance on the basis of the estimation result of the traffic condition estimating unit 14 and the information about other neighboring vehicles from the peripheral sensor 6. The driving assistance unit 15 transmits the driving assistance signal corresponding to the estimation result of the traffic condition estimating unit 14 or the information about other neighboring vehicles from the peripheral sensor 6 to the vehicle control unit 8 or the HMI 9, thereby performing driving assistance. The driving assistance includes, for example, ACC or brake assist and the provision of information about the driver. The driving assistance unit 15 functions as a driving assistance unit described in the claims.

Next, the flow of the process of the ECU 2 will be described with reference to the drawings.

Figure 4:
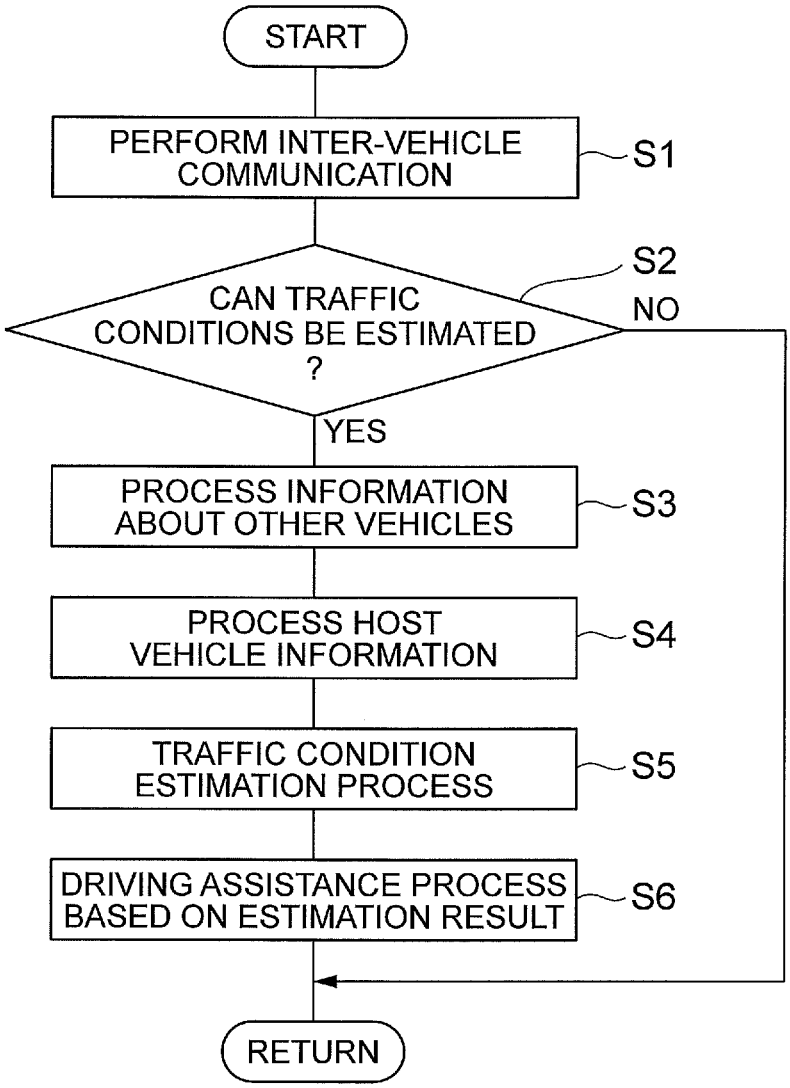
FIG. 4 is a flowchart illustrating the flow of the process of an ECU shown in FIG. 1.

As shown in FIG. 4, first, the information about other vehicles which is acquired by the inter-vehicle communication of the inter-vehicle communication unit 3 is transmitted to the estimation available or unavailable determining unit 11 of the ECU 2 (S1). Then, the estimation available or unavailable determining unit 11 determines whether it is possible to estimate the traffic conditions between the host vehicle M and another vehicle which has performed inter-vehicle communication, on the basis of the transmitted information about other vehicles (S2).

When it is determined that the traffic conditions between the host vehicle M and another vehicle which has performed inter-vehicle communication cannot be estimated, the estimation available or unavailable determining unit 11 ends the process. Then, the process returns to S1. When it is determined that another vehicle which has performed inter-vehicle communication corresponds to the communication vehicle N, the estimation available or unavailable determining unit 11 determines that it is possible to estimate the traffic conditions between the communication vehicle N and the host vehicle M.

When the estimation available or unavailable determining unit 11 determines that it is possible to estimate the traffic conditions, the other-vehicle information processing unit 12 recognizes the speed variation $V_N$ of the communication vehicle N on the basis of the information about the speed variation of other vehicles included in the information about other vehicles from the inter-vehicle communication unit 3 (S3).

When the other-vehicle information processing unit 12 recognizes the speed variation $V_N$ of the communication vehicle N, the host vehicle information processing unit 13 recognizes the speed variation $V_M$ of the host vehicle M corresponding to the speed variation $V_N$ of the communication vehicle N on the basis of the host vehicle speed variation information included in the host vehicle behavior information from the vehicle sensor 7 (S4).

The traffic condition estimating unit 14 estimates the traffic conditions between the communication vehicle N and the host vehicle M on the basis of the speed variation $V_N$ of the communication vehicle N recognized by the other-vehicle information processing unit 12 and the speed variation $V_M$ of the host vehicle M recognized by the host vehicle information processing unit 13 (S5). When the traffic condition estimating unit 14 estimates the traffic conditions between the communication vehicle N and the host vehicle M, the driving assistance unit 15 performs driving assistance on the basis of the estimation result of the traffic condition estimating unit 14 and the information about other neighboring vehicles from the peripheral sensor 6 (S6).

Next, the operation and effect of the vehicle driving assistance device 1 will be described.

When the traffic conditions between the host vehicle M and the communication vehicle N are bad, the behavior of the communication vehicle N is likely to affect the behavior of the host vehicle M. When the traffic conditions are good, the behavior of the communication vehicle N is less likely to affect the behavior of the host vehicle M. Therefore, according to the vehicle driving assistance device 1 of the first embodiment, it is possible to estimate the traffic conditions between the host vehicle M and the communication vehicle N on the basis of the host vehicle behavior information and the information about the behavior of other vehicles. According to the vehicle driving assistance device 1, it is possible to estimate the number of communication-incapable vehicles U between the host vehicle M and the communication vehicle N or traffic density therebetween as the traffic conditions. Therefore, it is possible to increase the amount of information which can be used for driving assistance for the host vehicle M and improve the reliability of driving assistance.

Furthermore, according to the vehicle driving assistance device 1, the traffic conditions between the host vehicle M and the communication vehicle N are estimated from the behavior of the host vehicle M and the behavior of the communication vehicle N acquired by inter-vehicle communication. Therefore, it is not necessary to have a large number of traffic condition maps which are classified for each region or each hour, unlike the related art. In addition, according to the vehicle driving assistance device 1, even when the traffic conditions between the host vehicle M and the communication vehicle N are changeable, it is possible to estimate the current traffic conditions with high accuracy, unlike the related art using the traffic condition map.

According to the vehicle driving assistance device 1, a speed variation which is noticeably affected by the communication vehicle N is considered as a behavior variation and the traffic conditions between the host vehicle M and the communication vehicle N are estimated on the basis of the speed variation of the communication vehicle N and the speed variation of the host vehicle M. In this way, it is possible to improve estimation accuracy.

According to the vehicle driving assistance device 1, inter-vehicle communication is performed to acquire the information about other vehicles. Therefore, it is possible to acquire the information about other vehicles with high accuracy, as compared to a case in which the information is acquired only from infrastructures or in-vehicle sensors.

[Second Embodiment]

A vehicle driving assistance device according to a second embodiment differs from the vehicle driving assistance device 1 according to the first embodiment in the estimation of the traffic conditions by the traffic condition estimating unit 14. Next, the vehicle driving assistance device according to the second embodiment will be described with reference to FIG. 5.

Figure 5:
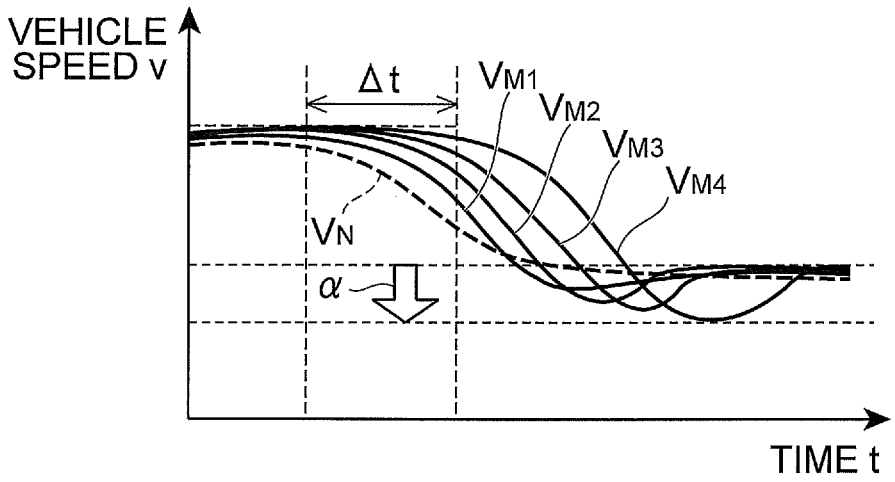
FIG. 5 is a graph illustrating the relationship between the speed variation of the communication vehicle and the speed variation of the host vehicle during deceleration.

FIG. 5 is a graph illustrating the relationship between the speed variation of a communication vehicle and the speed variation of a host vehicle during deceleration. In FIG. 5, a dashed line indicates the speed variation $V_N$ of a communication vehicle N during deceleration. In FIG. 5, solid lines indicate the speed variations $V_{M1}$ to $V_{M4}$ of a host vehicle M when the traffic conditions between the communication vehicle N and the host vehicle M are different. Specifically, it is assumed that the speed variation of the host vehicle M varies in the order of $V_{M1}$ to $V_{M4}$ under the traffic conditions that there are many communication-incapable vehicles U between the communication vehicle N and the host vehicle at a predetermined inter-vehicle distance L. That is, among $V_{M1}$ to $V_{M4}$, $V_{M1}$ is the speed variation of the host vehicle M when there are the smallest number of communication-incapable vehicles U between the communication vehicle N and the host vehicle M or there is no communication-incapable vehicle U therebetween. Among $V_{M1}$ to $V_{M4}$, $V_{M4}$ is the speed variation of the host vehicle M when there are the largest number of communication-incapable vehicles U between the communication vehicle N and the host vehicle M.

As shown in FIG. 5, for the speed variation of the host vehicle M with respect to the speed variation $V_N$ of the communication vehicle N, as the number of communication-incapable vehicles U between the communication vehicle N and the host vehicle M increases, a deceleration start delay time Δt increases and a vehicle speed reduction gain α and a deceleration gain β increase (not shown in FIG. 5). The deceleration start delay time Δt is a delay time between the deceleration start time of the communication vehicle N which travels ahead and the deceleration start time of the host vehicle M. The vehicle speed reduction gain α is the change ratio of the minimum vehicle speed of the host vehicle M to the minimum vehicle speed of the communication vehicle N. The deceleration gain β is the gain of the average deceleration of the host vehicle M to the average deceleration of the communication vehicle N. FIG. 5 shows the vehicle speed reduction gain α and the deceleration start delay time Δt of the speed variation $V_{m4}$ of the host vehicle M based on the speed variation $V_N$ of the communication vehicle N. In addition, deceleration determining the deceleration gain β corresponds to the slope of curves indicating the speed variations $V_N$ and $V_{m4}$.

A traffic condition estimating unit 14 according to the second embodiment calculates the deceleration start delay time Δt, the vehicle speed reduction gain α, and the deceleration gain β on the basis of the speed variation $V_N$ of the communication vehicle N during deceleration which is recognized by an other-vehicle information processing unit 12 and the speed variation $V_M$ of the host vehicle M during deceleration which is recognized by a host vehicle information processing unit 13. The traffic condition estimating unit 14 has a plurality of maps in which the deceleration start delay time Δt, the vehicle speed reduction gain α, and the deceleration gain β are associated with the traffic conditions between the communication vehicle N and the host vehicle M. The traffic condition estimating unit 14 estimates the traffic conditions between the communication vehicle N and the host vehicle M from the calculated deceleration start delay time Δt, vehicle speed reduction gain α, and deceleration gain β, using the maps.

In this case, the traffic condition estimating unit 14 performs weighting on an error for the conditions that the correlation between the communication vehicle N and the host vehicle M is strong using the following Expressions (3) to (6) and selects a map with the minimum error ϵ as the map used to estimate the traffic conditions. The following Expression 3 is for calculating the minimum value of the error ϵ. In Expression (3), $a_1$ to $a_3$ are predetermined coefficients. Expression (4) is for calculating an error $\epsilon_1$ between the calculated deceleration start delay time Δt and a deceleration start delay time $\Delta t_m$ defined in the map. Expression (5) is for calculating an error $\epsilon_2$ between the calculated vehicle speed reduction gain α and a vehicle speed reduction gain $\alpha_m$ defined in the map. Expression (6) is for calculating an error $\epsilon_3$ between the calculated deceleration gain β and a deceleration gain $\beta_m$ defined in the map.

[Equation 2]

$$\epsilon^2 = a_1\epsilon_1^2 + a_2\epsilon_2^2 + a_3\epsilon_3^2 \tag{3}$$

$$\epsilon_1 = \Delta t - \Delta t_m \tag{4}$$

$$\epsilon_2 = \alpha t - \alpha t_m \tag{5}$$

$$\epsilon_3 = \beta t - \beta t_m \tag{6}$$

According to the vehicle driving assistance device of the second embodiment, the deceleration start delay time Δt, the vehicle speed reduction gain α, and the deceleration gain β at which the speed variation $V_M$ of the host vehicle M is noticeably affected by the speed variation $V_N$ of the communication vehicle N are used to estimate the traffic conditions between the host vehicle M and the communication vehicle N. Therefore, it is possible to improve estimation accuracy. In addition, in the vehicle driving assistance device, the map with the minimum error ϵis selected and used to estimate the traffic conditions. Therefore, it is possible to further improve estimation accuracy.

[Third Embodiment]

A vehicle driving assistance device according to a third embodiment differs from the vehicle driving assistance device 1 according to the first embodiment in the estimation of the traffic conditions in the traffic condition estimating unit 14. Next, the vehicle driving assistance device according to the third embodiment will be described with reference to FIGS. 6 and 7.

Figure 6:
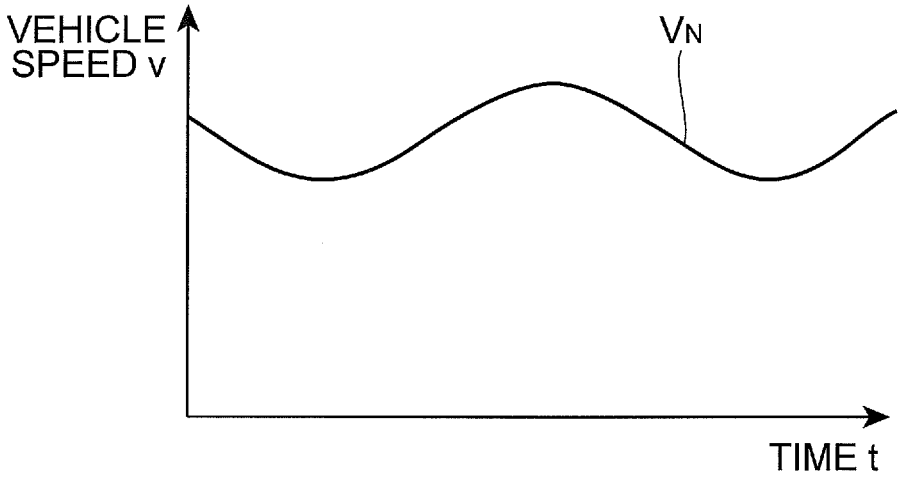
FIG. 6 is a graph illustrating the speed variation of the communication vehicle.
Figure 7:
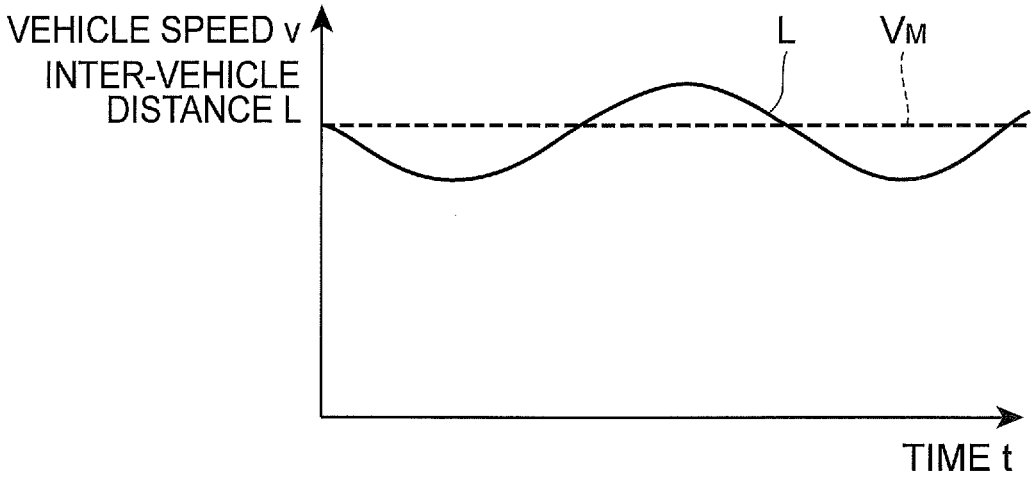
FIG. 7 is a graph illustrating the relationship between the speed variation of the host vehicle and a variation in an inter-vehicle distance corresponding to the speed variation of the communication vehicle shown in FIG. 6.
Figure 7:
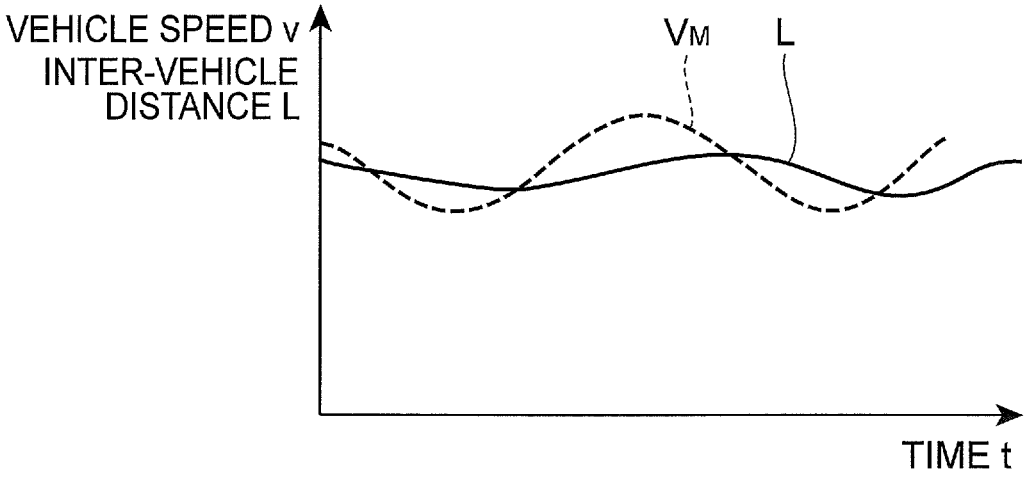

FIG. 6 is a graph illustrating the speed variation $V_N$ of a communication vehicle N. FIG. 7 is a graph illustrating the relationship between the speed variation $V_M$ of a host vehicle M and a variation in an inter-vehicle distance L corresponding to the speed variation $V_N$ of the communication vehicle N shown in FIG. 6. FIG. 7(*a*) shows the relationship between the variation in the inter-vehicle distance L and the speed variation $V_M$ of the host vehicle M when there is no communication-incapable vehicle U between the host vehicle M and the communication vehicle N (see FIG. 2(*a*)). FIG. 7(*b*) shows the relationship between the variation in the inter-vehicle distance L and the speed variation $V_M$ of the host vehicle M when there are a plurality of communication-incapable vehicles U between the host vehicle M and the communication vehicle N (see FIG. 2(*c*)).

As shown in FIGS. 6 and 7, the relationship between the variation in the inter-vehicle distance L in relation to the speed variation $V_N$ of the communication vehicle N, and the speed variation $V_M$ of the host vehicle M varies depending on the traffic conditions between the host vehicle M and the communication vehicle N which are related to each other. Therefore, when there is no correlation between the variation in the inter-vehicle distance L and the speed variation $V_N$ of the communication vehicle N or when the speed variation $V_N$ of the communication vehicle N is reflected in the variation in the inter-vehicle distance L, it may be estimated that there are a small number of communication-incapable vehicles U between the host vehicle M and the communication vehicle N from the traffic conditions. When the correlation between the speed variation $V_N$ of the communication vehicle N and the speed variation $V_M$ of the host vehicle M is strong than the variation in the inter-vehicle distance L, it may be estimated that there are a large number of communication-incapable vehicles U between the host vehicle M and the communication vehicle N from the traffic conditions. It is considered that the reason is as follows. When there are a large number of communication-incapable vehicles U, each vehicle sensitively reacts to the speed variation of the vehicle directly in front in order to maintain the inter-vehicle distance, which causes a series of a deceleration action and an acceleration action corresponding to the speed variation $V_N$ of the communication vehicle N. As a result, the variation in the inter-vehicle distance L tends to be reduced.

The traffic condition estimating unit 14 estimates the traffic conditions between the host vehicle M and the communication vehicle N on the basis of the speed variation $V_M$ of the host vehicle M and the variation in the inter-vehicle distance L due to the speed variation $V_N$ and the communication vehicle N.

Specifically, the traffic condition estimating unit 14 calculates the distance L between the host vehicle M and the communication vehicle N on the basis of information about the position of other vehicles included in information about other vehicles from an inter-vehicle communication unit 3 and information about the position of the host vehicle from a GPS receiving unit 5. The traffic condition estimating unit 14 calculates a phase delay time and an amplitude variation when a variation in the inter-vehicle distance L and the speed variation $V_M$ are recognized as a cycle, on the basis of the variation in the calculated inter-vehicle distance L and the speed variation $V_M$ of the host vehicle M recognized by a host vehicle information processing unit 13. The traffic condition estimating unit 14 has a map in which the phase delay time and the amplitude variation are associated with the traffic conditions between the host vehicle M and the communication vehicle N. The traffic condition estimating unit 14 estimates the traffic conditions between the host vehicle M and the communication vehicle N from the phase delay time and the amplitude variation, using the map.

According to the vehicle driving assistance device of the third embodiment, the influence of the speed variation $V_N$ of the communication vehicle N on the variation in the inter-vehicle distance L and the speed variation $V_M$ of the host vehicle M varies depending on the traffic conditions between the host vehicle M and the communication vehicle N. Therefore, the traffic conditions between the host vehicle M and the communication vehicle N are estimated on the basis of the variation in the inter-vehicle distance L and the speed variation $V_M$ of the host vehicle M. As a result, it is possible to further improve estimation accuracy.

[Fourth Embodiment]

A vehicle driving assistance device 21 according to a fourth embodiment differs from the vehicle driving assistance device 1 according to the first embodiment in the estimation of traffic conditions in a traffic condition estimating unit 23, the prediction of the behavior of an immediately preceding vehicle F which travels directly in front of a host vehicle M, and the execution of driving assistance on the basis of the prediction of the behavior of the immediately preceding vehicle F.

Next, the structure of the vehicle driving assistance device according to the fourth embodiment will be described with reference to FIG. 8.

Figure 8:
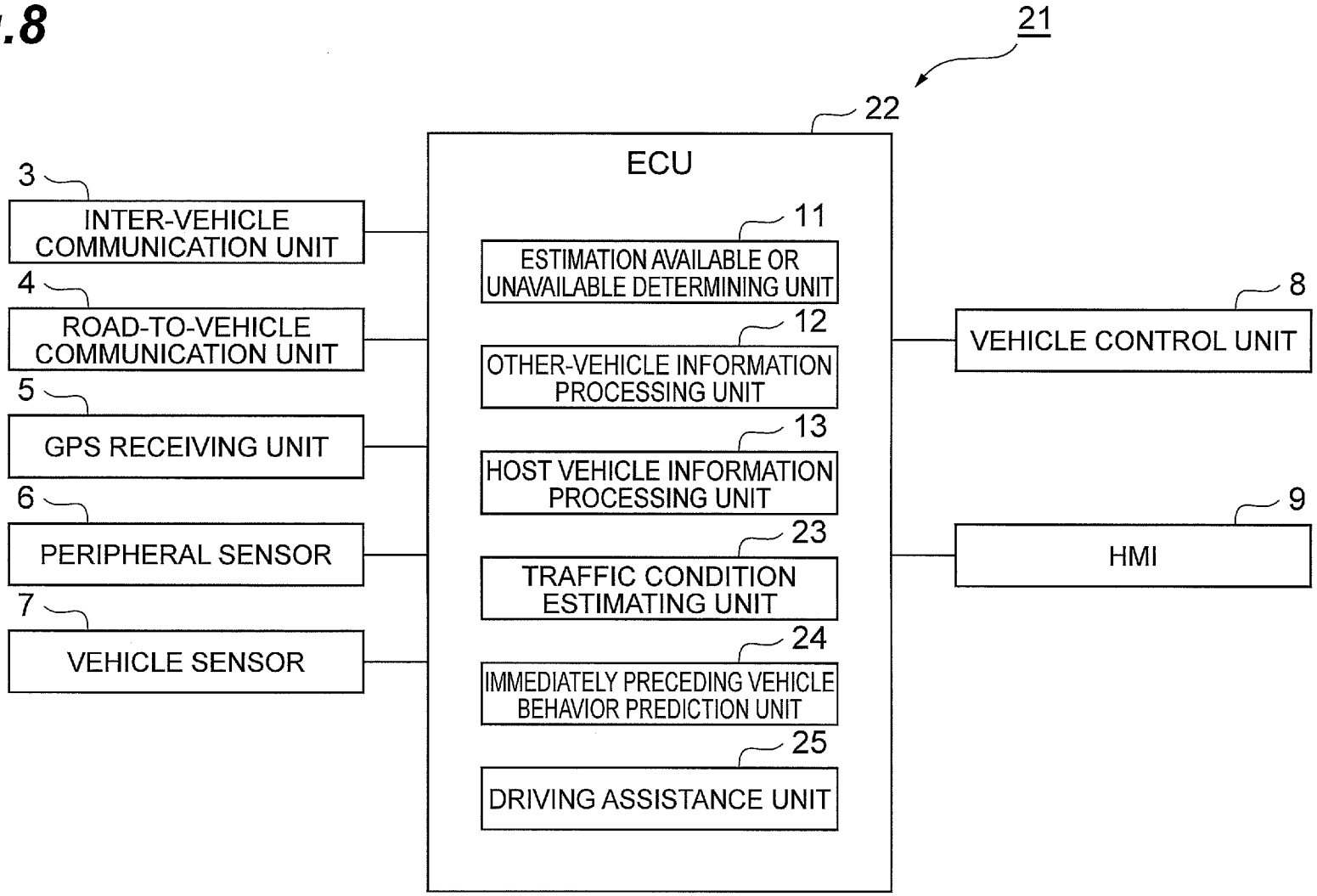
FIG. 8 is a block diagram illustrating a vehicle driving assistance device according to a second embodiment of the invention.

As shown in FIG. 8, an ECU 22 of the vehicle driving assistance device 21 according to the fourth embodiment includes an estimation available or unavailable determining unit 11, an other-vehicle information processing unit 12, a host vehicle information processing unit 13, a traffic condition estimating unit 23, an immediately preceding vehicle behavior prediction unit 24, and a driving assistance unit 25. The estimation available or unavailable determining unit 11, the other-vehicle information processing unit 12, and the host vehicle information processing unit 13 are the same as those according to the first embodiment and thus the description thereof will not be repeated.

The traffic condition estimating unit 23 estimates the traffic conditions between the host vehicle M and the communication vehicle N on the basis of the speed variation $V_M$ of the host vehicle M included in host vehicle behavior information, the speed variation $V_N$ of the communication vehicle N included in information about other vehicles, and information about road conditions between the host vehicle M and the communication vehicle N. The information about road conditions is information about, for example, intersections, traffic signals, the presence or absence of a crossing or traffic regulation, and the display conditions of traffic signals. The information about road conditions is acquired by, for example, the road-to-vehicle communication of a road-to-vehicle communication unit 4. In addition, the information about intersections, traffic signals, and the presence or absence of crossings may be acquired from map data which is stored in the ECU 22 in advance. The traffic condition estimating unit 23 according to the fourth embodiment may estimate the traffic conditions using, for example, the deceleration start delay time Δt described in the second embodiment or the inter-vehicle distance L described in the third embodiment.

The immediately preceding vehicle behavior prediction unit 24 predicts the behavior of the immediately preceding vehicle F which travels directly in front of the host vehicle M on the basis of the information about other vehicles from the communication vehicle N and the estimation result of the traffic conditions by the traffic condition estimating unit 23. The immediately preceding vehicle F is a vehicle which travels between the host vehicle M and the communication vehicle N. In this case, the term "directly in front of" means that the distance between the host vehicle M and the immediately preceding vehicle F is so short that there is no vehicle therebetween and is not related to the distance between the host vehicle M and the immediately preceding vehicle F. The immediately preceding vehicle F may be a vehicle which can perform inter-vehicle communication or a vehicle which cannot perform inter-vehicle communication. The immediately preceding vehicle behavior prediction unit 24 predicts the behavior of the immediately preceding vehicle F, such as a speed variation $V_F$ or a position variation.

Figure 9:
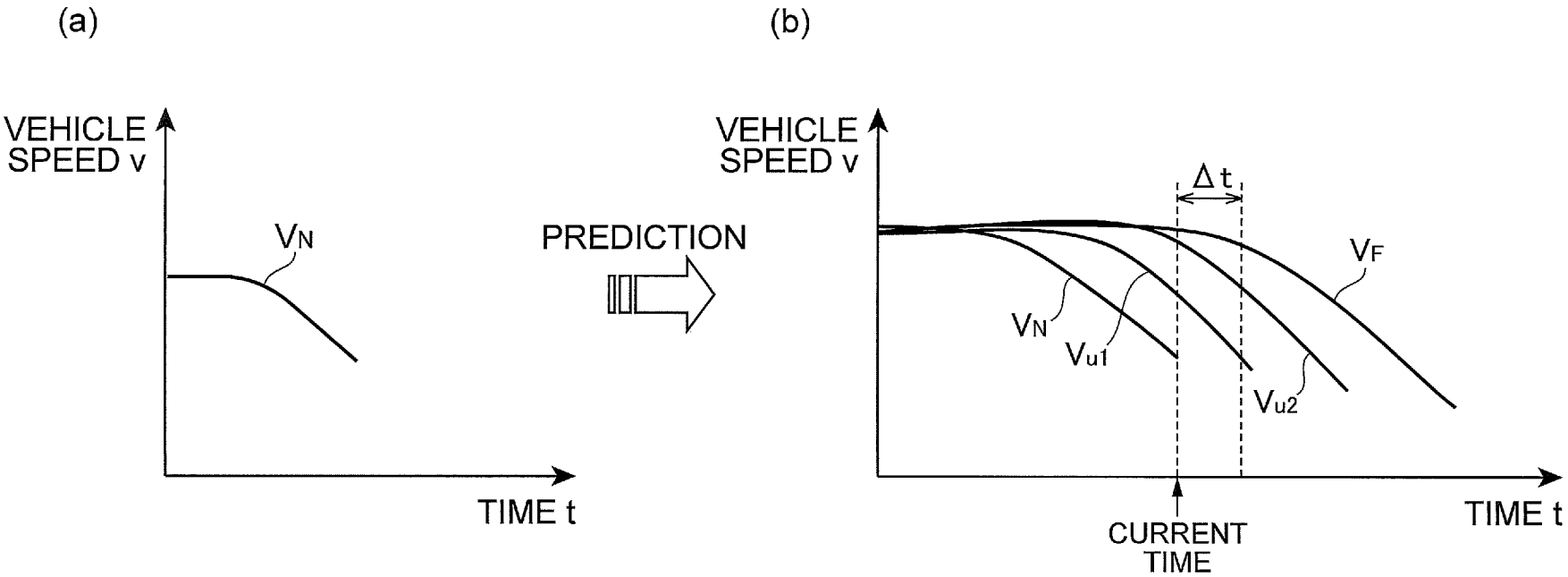
FIG. 9(*a*) is a graph illustrating the speed variation of another vehicle which can acquire information about the behavior of other vehicles.

Next, an example in which the speed variation $V_F$ of the immediately preceding vehicle F is predicted will be described. The prediction of the behavior of the immediately preceding vehicle F when there are two following vehicles U1 and U2 (i.e., any two of the U vehicles found in FIG. 2) between the communication vehicle N and the immediately preceding vehicle F will be described. FIG. 9(*a*) is a graph illustrating the speed variation $V_N$ of the communication vehicle N. FIG. 9(*b*) is a graph illustrating the prediction result of the speed variation VF of the immediately preceding vehicle F based on the speed variation $V_N$ of the communication vehicle N shown in FIG. 9(*a*).

The immediately preceding vehicle behavior prediction unit 24 predicts the speed variation of the following vehicle after a predetermined delay time Δt on the assumption that, when the speed of the communication vehicle N is changed, the speed of the following vehicle is changed after the predetermined delay time Δt. When the speed variation $V_N$ of the communication vehicle N shown in FIG. 9(*a*) is recognized, the immediately preceding vehicle behavior prediction unit 24 predicts the speed variation $V_{U1}$ of the following vehicle U1 which travels just behind the communication vehicle N using the following Expression (7). In Expression (7), $A_{U1}$ is the acceleration variation of the following vehicle U1, t is the current time, Δt is a delay time, and γ is a predetermined gain coefficient.

[Equation 3]

$$A_{u1}(t+\Delta t)=\gamma(V_N(t)-V_{u1}(t)) \quad (7)$$

As shown in FIG. 9(*b*), the immediately preceding vehicle behavior prediction unit 24 predicts the speed variation $V_{U1}$ of the following vehicle U1 using the above-mentioned process and then predicts the speed variation $V_{u2}$ of the following vehicle U2 which is behind the following vehicle U1 in the same manner. Then, the immediately preceding vehicle behavior prediction unit 24 predicts the speed variation $V_F$ of the immediately preceding vehicle F from the speed variation $V_{U2}$ of the following vehicle U2. For the number of other vehicles between the communication vehicle N and the immediately preceding vehicle F, the estimation result of the traffic conditions by the traffic condition estimating unit 23 is used. Alternatively, the immediately preceding vehicle behavior prediction unit 24 may estimate the number of other vehicles using traffic information, such as the average traffic density of the road on which the host vehicle M is traveling. The immediately preceding vehicle behavior prediction unit 24 predicts the behavior of the immediately preceding vehicle F, considering information about road conditions between the communication vehicle N and the immediately preceding vehicle F.

The driving assistance unit 25 performs driving assistance on the basis of the behavior prediction result of the immediately preceding vehicle F by the immediately preceding vehicle behavior prediction unit 24. The driving assistance unit 25 performs look-ahead driving assistance for the host vehicle M on the basis of the behavior prediction result of the immediately preceding vehicle F. In addition, the driving assistance unit 25 performs driving assistance on the basis of the information about the road conditions between the host vehicle M and the immediately preceding vehicle F.

Figure 10:
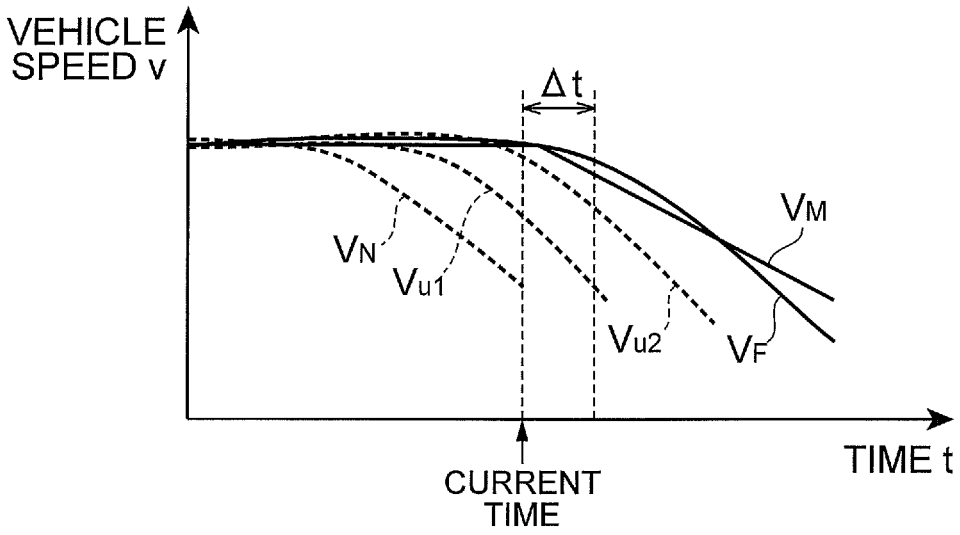
FIG. 10 is a graph illustrating the driving assistance control of the host vehicle based on the prediction result shown in FIG. 9(*b*).

FIG. 10 is a graph illustrating driving assistance control for the host vehicle M on the basis of the prediction result shown in FIG. 9(*b*). As shown in FIG. 10, the driving assistance unit 25 performs look-ahead driving assistance for the host vehicle M on the basis of the prediction result of the speed variation $V_F$ of the immediately preceding vehicle F. The driving assistance unit 25 performs driving assistance to most effectively decelerate the host vehicle M in correspondence with the deceleration of the immediately preceding vehicle F.

The driving assistance unit 25 calculates the target speed and target position of the host vehicle in consideration of the traveling route of the immediately preceding vehicle F, on the basis of the behavior prediction result of the immediately preceding vehicle F. The driving assistance unit 25 calculates target deceleration or target acceleration for reaching the calculated target speed and target position using the following Expression (8). In Expression (8), "a" is target deceleration or target acceleration, $V_{pre}$ is the predicted speed of the immediately preceding vehicle F, $V_{now}$ is the current speed of the immediately preceding vehicle F, $X_{pre}$ is the predicted speed of the immediately preceding vehicle F, and $X_{now}$ is the current position of the immediately preceding vehicle F.

[Equation 4]

$$a = \frac{V_{pre}^2 - V_{now}^2}{2\times(X_{pre} - X_{now})}$$

Next, the flow of the process of the ECU 22 according to the fourth embodiment will be described with reference to the drawings.

Figure 11:
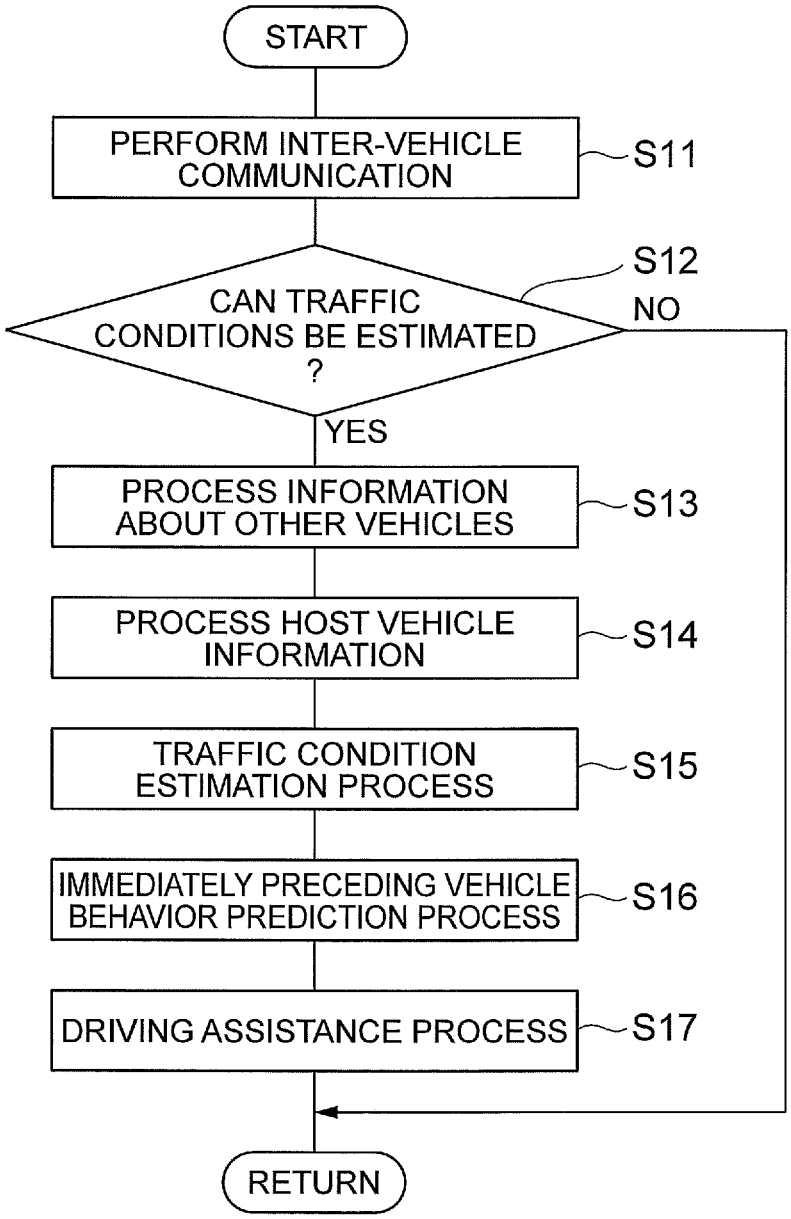
FIG. 11 is a flowchart illustrating the flow of the process of an ECU according to a fourth embodiment.

As shown in FIG. 11, first, the information about other vehicles which is acquired by the inter-vehicle communication of the inter-vehicle communication unit 3 is transmitted to the estimation available or unavailable determining unit 11 of the ECU 22 (S11). Then, the estimation available or unavailable determining unit 11 determines whether it is possible to estimate the traffic conditions between the host vehicle M and another vehicle which has performed inter-vehicle communication on the basis of the transmitted information about other vehicles (S12).

When it is determined that the traffic conditions between the host vehicle M and another vehicle which has performed inter-vehicle communication cannot be estimated, the estimation available or unavailable determining unit 11 ends the process. Then, the process returns to S11. When it is determined that another vehicle which has performed inter-vehicle communication corresponds to the communication vehicle N, the estimation available or unavailable determining unit 11 determines that the traffic conditions between the communication vehicle N and the host vehicle M can be estimated.

When the estimation available or unavailable determining unit determines that the traffic conditions can be estimated, the other-vehicle information processing unit 12 recognizes the speed variation $V_N$ of the communication vehicle N on the basis of the information about the speed variation of other vehicle included in the information about other vehicles from the inter-vehicle communication unit 3 (S13).

When the other-vehicle information processing unit 12 recognizes the speed variation $V_N$ of the communication vehicle N, the host vehicle information processing unit 13 recognizes the speed variation $V_M$ of the host vehicle M corresponding to the speed variation $V_N$ of the communication vehicle N, on the basis of the host vehicle speed variation information included in the host vehicle behavior information from the vehicle sensor 7 (S14).

The traffic condition estimating unit 23 estimates the traffic conditions between the communication vehicle N and the host vehicle M, on the basis of the speed variation $V_N$ of the communication vehicle N recognized by the other-vehicle information processing unit 12, the speed variation $V_M$ of the host vehicle M recognized by the host vehicle information processing unit 13, and information about the road conditions between the host vehicle M and the communication vehicle N (S15).

Then, the immediately preceding vehicle behavior prediction unit 24 predicts the behavior of the immediately preceding vehicle F which travels directly in front of the host vehicle M, on the basis of the information about other vehicles of the communication vehicle N from the inter-vehicle communication unit 3 and the estimation result of the traffic conditions by the traffic condition estimating unit 23 (S16). The driving assistance unit 25 performs driving assistance for the host vehicle M on the basis of the behavior prediction result of the immediately preceding vehicle F by the immediately preceding vehicle behavior prediction unit 24 and the information about the road conditions between the host vehicle M and the immediately preceding vehicle F (S17).

Next, the operation and effect of the vehicle driving assistance device 21 will be described.

According to the vehicle driving assistance device 21 of the fourth embodiment, the influence of the behavior of the communication vehicle N on the immediately preceding vehicle F can be estimated from the traffic conditions between the communication vehicle N and the host vehicle M estimated by the traffic condition estimating unit 23. Therefore, it is possible to predict the behavior of the immediately preceding vehicle F on the basis of the information about other vehicles of the communication vehicle N which travels in front of the immediately preceding vehicle F. Thus, according to the vehicle driving assistance device 21, it is possible to predict the behavior of the immediately preceding vehicle F from the behavior of the communication vehicle N and perform look-ahead driving assistance based on the behavior prediction result of the immediately preceding vehicle F.

Figure 12:
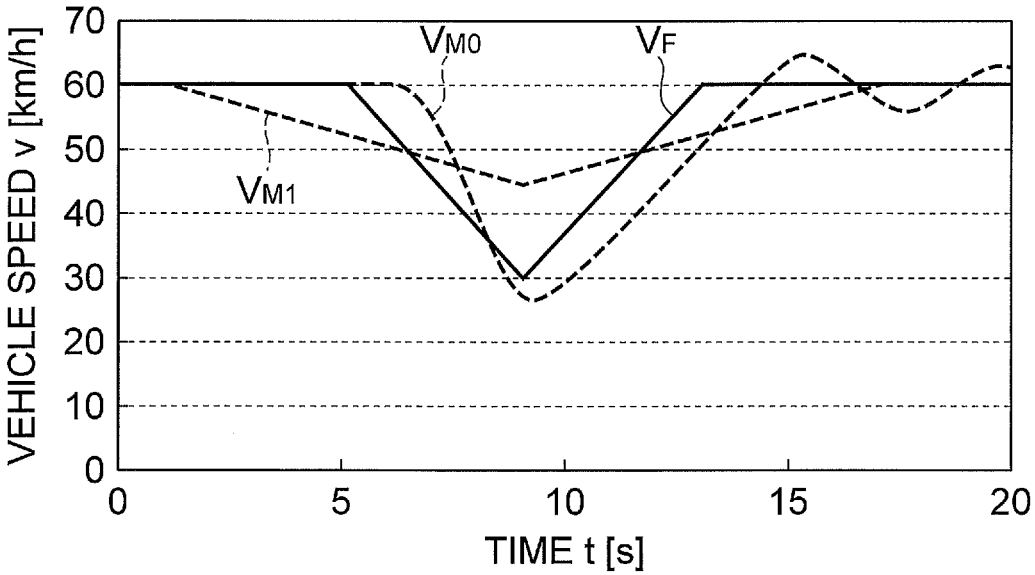
FIG. 12 is a graph illustrating the driving assistance control of the host vehicle for the speed variation of an immediately preceding vehicle.

Next, the look-ahead driving assistance will be described with reference to FIG. 12. FIG. 12 is a graph illustrating the driving assistance control of the host vehicle M for the speed variation $V_F$ of the immediately preceding vehicle F. In FIG. 12, $V_{M0}$ indicates the speed variation of the host vehicle M by driving assistance based on feedback control according to the related art. In the feedback control according to the related art, driving assistance for the speed variation of the host vehicle M is performed on the basis of the behavior detection result of the immediately preceding vehicle F, not the behavior prediction result of the immediately preceding vehicle F. Therefore, in the speed variation $V_{M0}$ of the host vehicle M, the speed is changed according to the speed variation $V_F$ of the immediately preceding vehicle F, which results in response delay.

In FIG. 12, $V_{M1}$ indicates the speed variation of the host vehicle M by look-ahead driving assistance based on feedforward control. As shown in FIG. 12, in the look-ahead driving assistance, since driving assistance is performed on the basis of the behavior prediction result of the immediately preceding vehicle F, smooth and effective driving control is achieved.

When there is an intersection between the host vehicle M and the immediately preceding vehicle F, the influence of the behavior of the immediately preceding vehicle F on the host vehicle M is changed. Therefore, according to the vehicle driving assistance device 21, since driving assistance is performed considering the information about the road conditions between the host vehicle M and the immediately preceding vehicle F, it is possible to improve the reliability of driving assistance.

[Fifth Embodiment]

Figure 13:
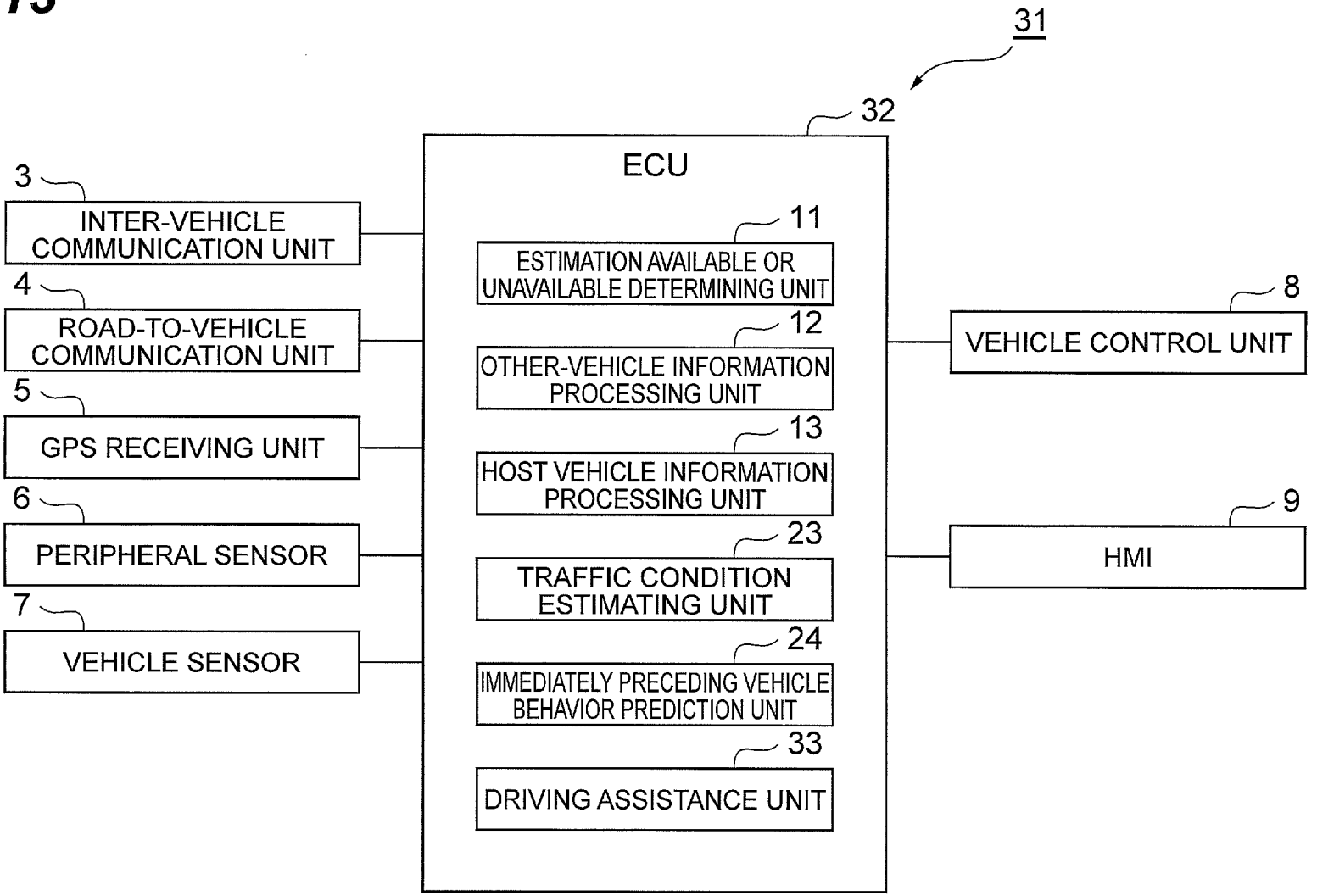
FIG. 13 is a block diagram illustrating a vehicle driving assistance device according to a third embodiment of the invention.

As shown in FIG. 13, a vehicle driving assistance device 31 according to a fifth embodiment differs from the vehicle driving assistance device 21 according to the fourth embodiment in that the amount of control of look-ahead driving assistance is adjusted on the basis of the traveling relationship between a host vehicle M and an immediately preceding vehicle F.

Figure 14:
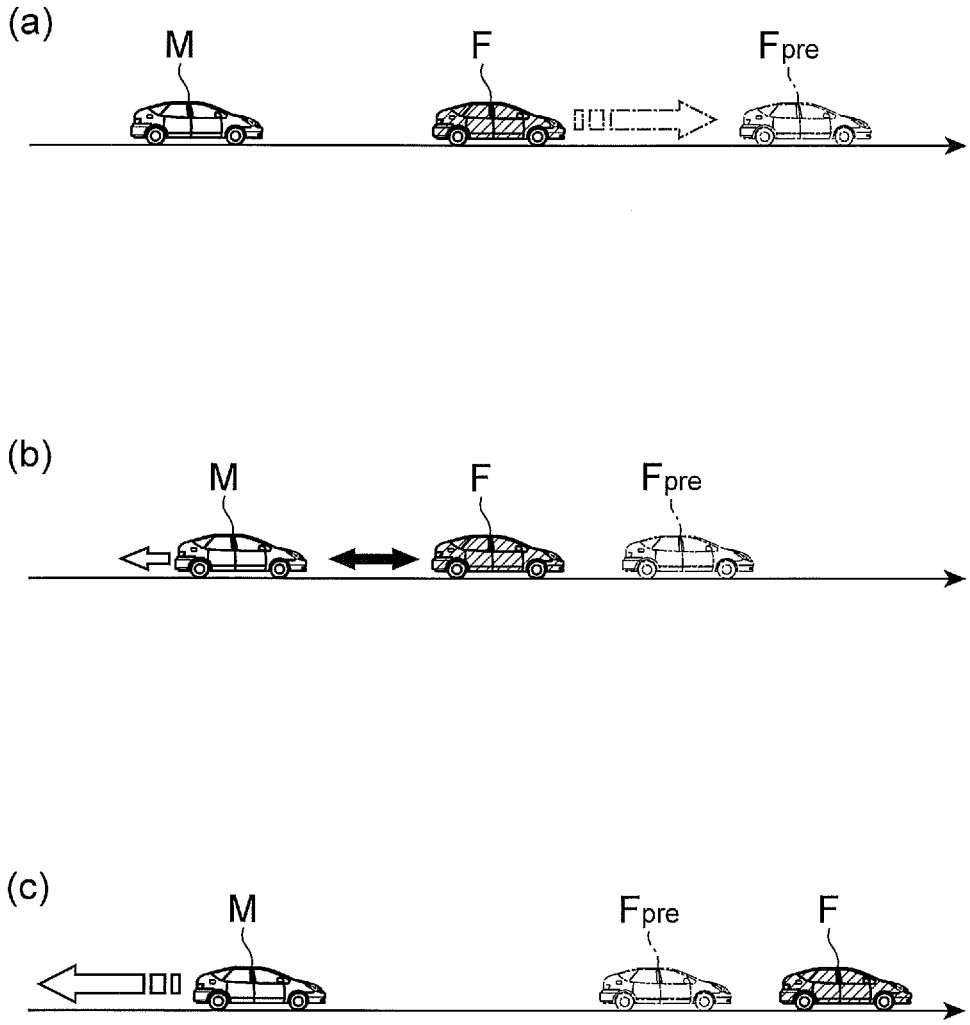
FIG. 14(*a*) is a diagram illustrating the traveling relationship between the host vehicle and the immediately preceding vehicle before look-ahead driving assistance is performed.

The vehicle driving assistance device 31 according to the fifth embodiment considers the possibility that the behavior of the immediately preceding vehicle F will be different from the behavior prediction result when the look-ahead driving assistance described in the fourth embodiment is performed. FIG. 14(*a*) is a diagram illustrating the traveling relationship between the host vehicle M and the immediately preceding vehicle F before driving assistance is performed. FIG. 14(*b*) is a diagram illustrating a situation in which the deceleration of the immediately preceding vehicle F is greater than a predicted value in the situation shown in FIG. 14(*a*). FIG. 14(*c*) is a diagram illustrating a situation in which the deceleration of the immediately preceding vehicle F is less than a predicted value in the situation shown in FIG. 14(*a*).

The position of the immediately preceding vehicle F predicted by the vehicle driving assistance device 31 in the situation shown in FIG. 14(*a*) is represented by $F_{pre}$. As shown in FIG. 14(*b*), when the deceleration of the immediately preceding vehicle F is greater than a predicted value, look-ahead driving assistance corresponding to the position $F_{pre}$ is performed and the distance between the host vehicle M and the immediately preceding vehicle F is too short. On the other hand, as shown in FIG. 14(*c*), when the deceleration of the immediately preceding vehicle F is less than a predicted value, look-ahead driving assistance corresponding to the position $F_{pre}$ is performed and the distance between the host vehicle M and the immediately preceding vehicle F is too long. During the acceleration of the immediately preceding vehicle F, when the behavior of the immediately preceding vehicle F is different from the predicted behavior, the same problems arise.

In the vehicle driving assistance device 31 according to the fifth embodiment, the amount of control of the look-ahead driving assistance is adjusted on the basis of the traveling relationship between the host vehicle M and the immediately preceding vehicle F to solve the above-mentioned problems.

Specifically, in the ECU 32 of the vehicle driving assistance device 31, the driving assistance unit 33 recognizes the traveling relationship between the host vehicle M and the immediately preceding vehicle F. The driving assistance unit 33 recognizes the traveling relationship between the host vehicle M and the immediately preceding vehicle F on the basis of the information about other neighboring vehicles from the peripheral sensor 6 and the host vehicle behavior information from the vehicle sensor 7. Examples of the traveling relationship include the inter-vehicle distance, relative speed, and relative acceleration between the host vehicle M and the immediately preceding vehicle F.

The driving assistance unit 33 adjusts the amount of control of driving assistance based on the prediction result of the immediately preceding vehicle behavior prediction unit 24, on the basis of the current traveling relationship between the host vehicle M and the immediately preceding vehicle F. For example, when it is determined that the distance between the host vehicle M and the immediately preceding vehicle F is too short or too long from the current traveling relationship between the host vehicle M and the immediately preceding vehicle F, the driving assistance unit 33 adjusts the amount of control of look-ahead driving assistance to maintain an appropriate traveling relationship.

The driving assistance unit 33 adjusts the assistance acceleration and deceleration (amount of control) of the look-ahead driving assistance related to the speed variation of the host vehicle M using the following Expression (9). In Expression (9), $\alpha 1$ is an adjustment variable which is calculated on the basis of the traveling relationship between the host vehicle M and the immediately preceding vehicle F.

[Equation 5]

$$\text{Assistance acceleration and deceleration} = \alpha 1 \times (\text{look-ahead acceleration and deceleration}) \quad (9)$$

In addition, when the host vehicle M performs follow-up control for the immediately preceding vehicle F, the driving assistance unit 33 adjusts the weighting between the look-ahead driving assistance and the follow-up control on the basis of the current traveling relationship between the host vehicle M and the immediately preceding vehicle F. The driving assistance unit 33 adjusts each of the amount of control of the look-ahead driving assistance and the amount of control of the follow-up control on the basis of the current traveling relationship between the host vehicle M and the immediately preceding vehicle F. When it is determined that the distance between the host vehicle M and the immediately preceding vehicle F is too short or too long from the current traveling relationship between the host vehicle M and the immediately preceding vehicle F, the driving assistance unit 33 adjusts weighting such that follow-up control has priority.

Specifically, the driving assistance unit 33 adjusts the weighting of the look-ahead acceleration and deceleration related to the look-ahead driving assistance and the acceleration and deceleration related to the follow-up control using the following Expression (10). In Expression (10), $\alpha 2$ and $\beta 2$ are weighting variables which are calculated on the basis of the traveling relationship between the host vehicle M and the immediately preceding vehicle F.

Equation 6]

$$\text{Assistance acceleration and deceleration} = \alpha 2 \times (\text{look-ahead acceleration And deceleration}) + \beta 2 (\text{acceleration and deceleration of follow-up control}) \quad (10)$$

Next, the flow of the process of the ECU 32 according to the fifth embodiment will be described with reference to the drawings.

Figure 15:
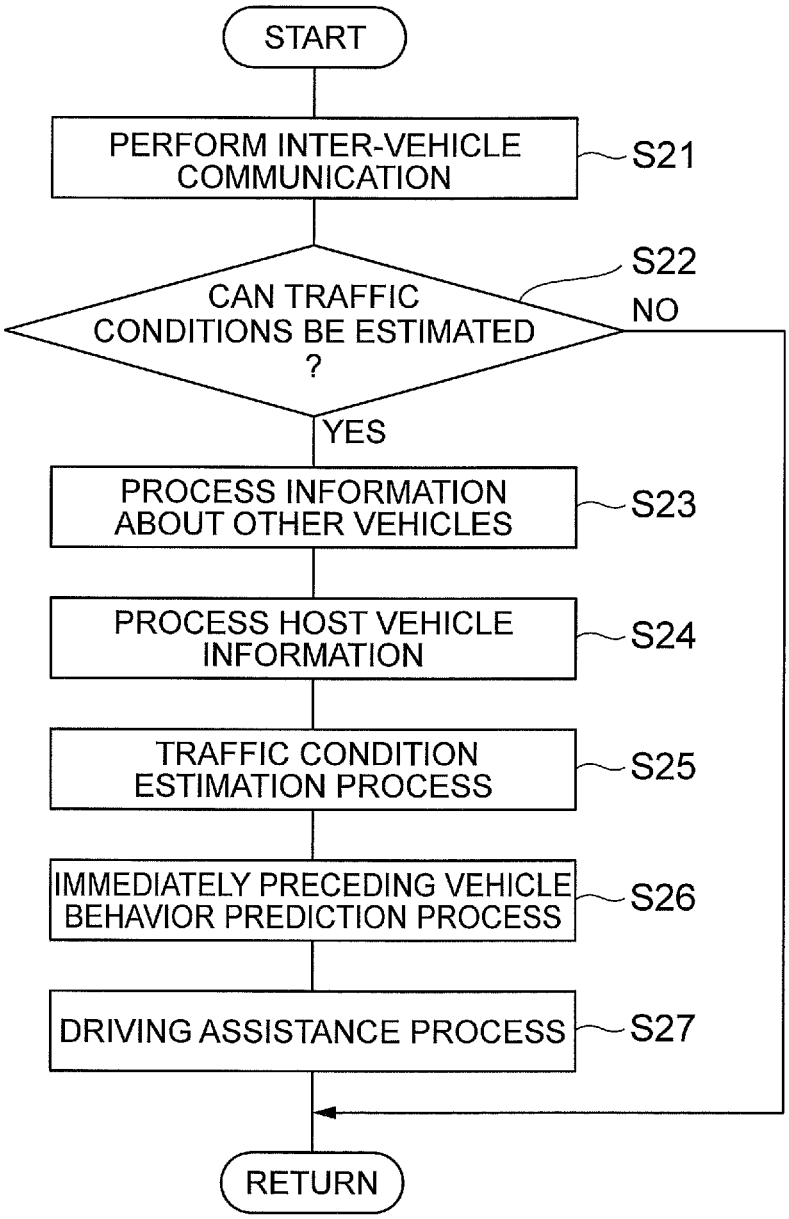
FIG. 15 is a flowchart illustrating the flow of the process of an ECU according to a fifth embodiment.

As shown in FIG. 15, first, the information about other vehicles which is acquired by the inter-vehicle communication of the inter-vehicle communication unit 3 is transmitted to the estimation available or unavailable determining unit 11 of the ECU 32 (S21). Then, the estimation available or unavailable determining unit 11 determines whether it is possible to estimate the traffic conditions between the host vehicle M and another vehicle which has performed inter-vehicle communication on the basis of the transmitted information about other vehicles (S22).

When it is determined that the traffic conditions between the host vehicle M and another vehicle which has performed inter-vehicle communication cannot be estimated, the estimation available or unavailable determining unit 11 ends the process. Then, the process returns to S21. When it is determined that another vehicle which has performed inter-vehicle communication corresponds to the communication vehicle N, the estimation available or unavailable determining unit 11 determines that it is possible to estimate the traffic conditions between the communication vehicle N and the host vehicle M.

When the estimation available or unavailable determining unit 11 determines that it is possible to estimate the traffic conditions, the other-vehicle information processing unit 12 recognizes the speed variation $V_N$ of the communication vehicle N on the basis of the information about the speed variation of other vehicles included in the information about other vehicles from the inter-vehicle communication unit 3 (S23).

When the other-vehicle information processing unit 12 recognizes the speed variation $V_N$ of the communication vehicle N, the host vehicle information processing unit 13 recognizes the speed variation $V_M$ of the host vehicle M corresponding to the speed variation $V_N$ of the communication vehicle N on the basis of the host vehicle speed variation information included in the host vehicle behavior information from the vehicle sensor 7 (S24).

The traffic condition estimating unit 23 estimates the traffic conditions between the communication vehicle N and the host vehicle M on the basis of the speed variation $V_N$ of the communication vehicle N recognized by the other-vehicle information processing unit 12, the speed variation $V_M$ of the host vehicle M recognized by the host vehicle information processing unit 13, and the information about the road conditions between the host vehicle M and the communication vehicle N (S25).

Then, the immediately preceding vehicle behavior prediction unit 24 predicts the behavior of the immediately preceding vehicle F which travels directly in front of the host vehicle M, on the basis of the information about other vehicles of the communication vehicle N from the inter-vehicle communication unit 3 and the estimation result of the traffic conditions by the traffic condition estimating unit 23 (S26).

The driving assistance unit 33 performs driving assistance for the host vehicle M on the basis of the behavior prediction result of the immediately preceding vehicle F by the immediately preceding vehicle behavior prediction unit 24 and the information about the road conditions between the host vehicle M and the immediately preceding vehicle F (S27). The driving assistance unit 33 adjusts a driving assistance control value on the basis of the current traveling relationship between the host vehicle M and the immediately preceding vehicle F. When it is determined that the distance between the host vehicle M and the immediately preceding vehicle F is too short during the deceleration of the host vehicle M, the driving assistance unit 33 adjusts the deceleration control value of the driving assistance to a large value. When it is determined that the distance between the host vehicle M and the immediately preceding vehicle F is too short during the acceleration of the host vehicle M, the driving assistance unit 33 adjusts the acceleration control value of the driving assistance to a small value.

When it is determined that the distance between the host vehicle M and the immediately preceding vehicle F is too long during the deceleration of the host vehicle M, the driving assistance unit 33 adjusts the deceleration control value of the driving assistance to a small value. When it is determined that the distance between the host vehicle M and the immediately preceding vehicle F is too long during the acceleration of the host vehicle M, the driving assistance unit 33 adjusts the acceleration control value of the driving assistance to a large value.

According to the vehicle driving assistance device 31 of the fifth embodiment, since the behavior of the immediately preceding vehicle F is likely to be different from the behavior prediction result of the immediately preceding vehicle behavior prediction unit 24, the amount of control of the look-ahead driving assistance is adjusted on the basis of the traveling relationship between the host vehicle M and the immediately preceding vehicle F. Therefore, it is possible to prevent the distance between the host vehicle M and the immediately preceding vehicle F from being too short or too long. This contributes to improving the reliability of the look-ahead driving assistance.

The invention is not limited to the above-described embodiments.

For example, the functions of the vehicle driving assistance devices according to the first to fifth embodiments may be appropriately combined with each other. In addition, the invention can be combined with the estimation result of the traffic conditions obtained by various methods according to the related art. As such, the invention can be combined with the estimation result of the traffic conditions obtained by various methods to further improve the estimation accuracy of traffic conditions.

In the above-described embodiments, the maps are not classified according to, for example, the traveling place or hours. However, plural kinds of maps which are classified according to the approximate locations, such as a highway, an arterial road, or a narrow road, and hours may be provided and a map may be selected according to the current position or traveling time of the host vehicle M. In this case, the invention can also improve the estimation accuracy of traffic conditions.

The invention is not limited to the structure in which the traffic conditions between the host vehicle M and the communication vehicle N are estimated on the basis of the speed variation or a variation in the inter-vehicle distance. For example, in the vehicle driving assistance device 1 according to the first embodiment, the traffic conditions between the host vehicle M and the communication vehicle N may be estimated from a delay time between the time when the stop lamp of the communication vehicle N is turned on and the time when the stop lamp of the host vehicle M is turned on. In addition, the vehicle driving assistance device 1 may estimate the traffic conditions between the host vehicle M and the communication vehicle N on the basis of the time difference or correlation between the accelerator work of the communication vehicle N and the accelerator work of the host vehicle M. Furthermore, the vehicle driving assistance device 1 may estimate the traffic conditions between the host vehicle M and the communication vehicle N on the basis of the correlation between variations in the acceleration and deceleration of the host vehicle M and the communication vehicle N or the correlation between variations in the steering angles of the host vehicle M and the communication vehicle N.

In the vehicle driving assistance device according to the second embodiment, the deceleration start delay time $\Delta t$, the vehicle speed reduction gain $\alpha$, and the deceleration gain $\beta$ are all used to estimate the traffic conditions. However, the invention is not limited thereto. For example, only one or two of the deceleration start delay time $\Delta t$, the vehicle speed reduction gain $\alpha$, and the deceleration gain $\beta$ may be used to estimate the traffic conditions.

In the vehicle driving assistance device according to the invention, when the host vehicle M is scheduled to change the lane and there are two or more other vehicles which can perform inter-vehicle communication on the lane to which the host vehicle M will change its lane, the traffic conditions between other vehicles may be estimated on the basis of information about the behavior of other vehicles. In this case, the host vehicle M can check the influence of the lane change on a group of the vehicle on the lane to which the host vehicle M will change its lane. In addition, when there is only one vehicle which can perform inter-vehicle communication on the lane to which the host vehicle M will change its lane, the peripheral sensor 6 of the host vehicle M may acquire information about the behavior of another arbitrary vehicle on the lane, thereby estimating the traffic conditions between the arbitrary vehicle and another vehicle which can perform inter-vehicle communication.

Even when the host vehicle M and the communication vehicle N travel in different lanes, the invention can estimate the traffic conditions between the communication vehicle N and the host vehicle M according to circumstances.

The invention is not limited to the structure which the information about other vehicles is acquired by inter-vehicle communication. For example, the information about other vehicles may be acquired from, for example, infrastructures or in-vehicle sensors.

Industrial Applicability

The invention can be applied to vehicle driving assistance devices which perform driving assistance for vehicles.

REFERENCE SIGNS LIST

1,21,31: VEHICLE DRIVING ASSISTANCE DEVICE

3: INTER-VEHICLE COMMUNICATION UNIT (OTHER-VEHICLE BEHAVIOR INFORMATION ACQUIRING UNIT)

4: ROAD-TO-VEHICLE COMMUNICATION UNIT

5: GPS RECEIVING UNIT (VEHICLE POSITION INFORMATION ACQUIRING UNIT)

6: PERIPHERAL SENSOR

7: VEHICLE SENSOR (VEHICLE BEHAVIOR INFORMATION ACQUIRING UNIT)

8: VEHICLE CONTROL UNIT

9: HUMAN MACHINE INTERFACE (HMI)

11: ESTIMATION AVAILABLE OR UNAVAILABLE DETERMINING UNIT

12: OTHER-VEHICLE INFORMATION PROCESSING UNIT

13: HOST VEHICLE INFORMATION PROCESSING UNIT

14, 23: TRAFFIC CONDITION ESTIMATING UNIT (TRAFFIC CONDITION ESTIMATING UNIT)

15, 25, 33: DRIVING ASSISTANCE UNIT (DRIVING ASSISTANCE UNIT)

24: IMMEDIATELY PRECEDING VEHICLE BEHAVIOR PREDICTION UNIT (IMMEDIATELY PRECEDING VEHICLE BEHAVIOR PREDICTION UNIT)

The invention claimed is:

1. A vehicle driving assistance device comprising:

a vehicle behavior information acquiring unit that acquires vehicle behavior information about behavior of a vehicle;

an estimation available or unavailable determining unit that determines whether another vehicle that has performed inter-vehicle communication with the vehicle corresponds to an other vehicle travelling in front of the vehicle, and determines whether it is possible to estimate traffic conditions between the other vehicle and the vehicle;

an other-vehicle behavior information acquiring unit that acquires other-vehicle behavior information about behavior of the another vehicle that can perform inter-vehicle communication which travels in front of the vehicle in the same lane, through inter-vehicle communication between the vehicle and the another vehicle that can perform inter-vehicle communication, when the estimation available or unavailable determining unit has determined that estimating the traffic conditions between the other vehicle and the vehicle is possible;

a traffic condition estimating unit that estimates traffic conditions regarding a number of communication-incapable vehicles between the vehicle and the another vehicle in the same lane, on the basis of the vehicle behavior information acquired by the vehicle behavior information acquiring unit and the other-vehicle behavior information acquired by the other-vehicle behavior information acquiring unit; and a driving assistance unit that performs driving assistance on the basis of an estimation result of the traffic condition estimating unit, wherein the estimation available or unavailable determining unit determines it is impossible to estimate the traffic conditions when the other vehicle travels directly in front of the vehicle, the vehicle behavior information includes information about a speed variation of the vehicle, the other-vehicle behavior information includes information about a speed variation of the another vehicle, and the traffic condition estimating unit estimates traffic conditions between the vehicle and the another vehicle on the basis of the information on the speed variation of the another vehicle and the information about the speed variation of the vehicle, calculates a delay time between a deceleration start time of another vehicle and a deceleration start time of the vehicle on the basis of the information about the speed variation of another vehicle and the information about the speed variation of the vehicle, and estimates traffic conditions on the basis of the delay time.

2. The vehicle driving assistance device according to claim 1, wherein the traffic condition estimating unit calculates a deceleration gain of the speed variation of the vehicle to the speed variation of the another vehicle during deceleration on the basis of the information about the speed variation of the another vehicle and the information about the speed variation of the vehicle and estimates the traffic conditions between the vehicle and the another vehicle on the basis of the deceleration gain.

3. The vehicle driving assistance device according to claim 1, further comprising:

a vehicle position information acquiring unit that acquires position information of the vehicle, wherein the other-vehicle behavior information acquired by the other-vehicle behavior information acquiring unit includes position information of the another vehicle, and the traffic condition estimating unit calculates a distance between the vehicle and the another vehicle on the basis of the position information of the vehicle and the position information of the another vehicle and estimates the traffic conditions between the vehicle and the another vehicle on the basis of a variation in the inter-vehicle distance.

4. The vehicle driving assistance device according to claim 1 further comprising:

an immediately preceding vehicle behavior prediction unit that predicts behavior of an immediately preceding vehicle which travels directly in front of the vehicle on the basis of the other-vehicle behavior information and the estimation result of the traffic condition estimating unit, wherein the driving assistance unit performs the driving assistance on the basis of a behavior prediction result of the immediately preceding vehicle behavior prediction unit.

5. The vehicle driving assistance device according to claim 4, wherein the driving assistance unit performs the driving assistance on the basis of information about road conditions between the vehicle and the immediately preceding vehicle.

6. The vehicle driving assistance device according to claim 4, wherein the driving assistance unit adjusts an amount of control of the driving assistance based on the behavior prediction result of the immediately preceding vehicle behavior prediction unit, on the basis of a current traveling relationship between the vehicle and the immediately preceding vehicle.

* * * * *